US009136098B2

(12) United States Patent
Wildgoose et al.

(10) Patent No.: US 9,136,098 B2
(45) Date of Patent: Sep. 15, 2015

(54) ION GUIDE COUPLED TO MALDI ION SOURCE

(75) Inventors: Jason Lee Wildgoose, Stockport (GB); Steven Derek Pringle, Darwen (GB); Kevil Giles, Stockport (GB); Jeffery Mark Brown, Hyde (GB); Paul Murray, Manchester (GB); Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/130,465

(22) PCT Filed: Jul. 6, 2012

(86) PCT No.: PCT/GB2012/051607

§ 371 (c)(1),
(2), (4) Date: Mar. 19, 2014

(87) PCT Pub. No.: WO2013/005058

PCT Pub. Date: Jan. 10, 2013

(65) Prior Publication Data

US 2014/0191123 A1 Jul. 10, 2014

Related U.S. Application Data

(60) Provisional application No. 61/508,285, filed on Jul. 15, 2011.

(30) Foreign Application Priority Data

Jul. 6, 2011 (GB) ..... 1111568.0

(51) Int. Cl.

| | |
|---|---|
| ***H01J 49/40*** | (2006.01) |
| ***H01J 49/10*** | (2006.01) |
| ***H01J 49/06*** | (2006.01) |
| ***H01J 49/00*** | (2006.01) |

(52) U.S. Cl.

CPC ..... *H01J 49/10* (2013.01); *H01J 49/0031* (2013.01); *H01J 49/061* (2013.01); *H01J 49/065* (2013.01)

(58) Field of Classification Search

USPC ..... 250/281, 282, 283, 288

See application file for complete search history.

(56) References Cited

U.S. PATENT DOCUMENTS

| | | | |
|---|---|---|---|
| 4,442,354 | A | 4/1984 | Hurst et al. |
| 5,808,300 | A | 9/1998 | Caprioli |
| 6,639,217 | B1 | 10/2003 | Li |
| 6,734,421 | B2 | 5/2004 | Holle et al. |
| 6,800,846 | B2 | 10/2004 | Bateman et al. |
| 6,812,453 | B2 | 11/2004 | Bateman et al. |
| 7,189,963 | B2 | 3/2007 | Krutchinsky et al. |
| 7,504,640 | B2 | 3/2009 | Franzen et al. |

(Continued)

OTHER PUBLICATIONS

Aksouh et al, "*Influence of the Laser Beam Direction on the Molecular Ion Ejection Angle in Matrix-Assisted Laser Desorption/Ionization*", Rapid Communications in Mass Spectrometry, vol. 9, No. 6, pp. 515-518, 1995.

*Primary Examiner* — Nicole Ippolito

(74) *Attorney, Agent, or Firm* — Diederiks & Whitelaw, PLC

(57) ABSTRACT

A pulsed ion source is disclosed wherein the ion source is energized one or more times to generate a first group of ions and a second group of ions. The first and second groups of ions are simultaneously transmitted through an ion guide whilst keeping the first and second groups of ions isolated from each other.

20 Claims, 9 Drawing Sheets

(56) References Cited

U.S. PATENT DOCUMENTS

| | | | | |
|---|---|---|---|---|
| 7,893,401 | B2 | 2/2011 | Ding | |
| 8,581,181 | B2 | 11/2013 | Giles | |
| 2003/0155507 | A1* | 8/2003 | Hashimoto et al. | 250/292 |
| 2005/0092916 | A1 | 5/2005 | Vestal et al. | |
| 2008/0272293 | A1 | 11/2008 | Vestal | |
| 2012/0085903 | A1 | 4/2012 | Trimpin | |

* cited by examiner

ION GUIDE COUPLED TO MALDI ION SOURCE

CROSS-REFERENCE TO RELATED APPLICATIONS

This application is the National Stage of International Application No. PCT/GB2012/051607 filed 6 Jul. 2012, which claims priority from and the benefit of U.S. Provisional Patent Application Ser. No. 61/508,285 filed on 15 Jul. 2011 and United Kingdom Patent Application No. 1111568.0 filed on 6 Jul. 2011. The entire contents of these applications are incorporated herein by reference.

BACKGROUND TO THE INVENTION

The present invention relates to a method of mass spectrometry and a mass spectrometer.

Mass spectrometers configured for Matrix Assisted Laser Desorption Ionisation ("MALDI") are known. MALDI is a soft ionisation technique for mass spectrometry in which analyte molecules are prepared on the surface of a target plate. The analyte molecules are supported in a solid polycrystalline matrix. A pulse of laser radiation, with a typical duration of a few nanoseconds, is directed onto the MALDI sample. The laser radiation is strongly absorbed by the matrix molecules.

The pulse of laser energy results in rapid heating of the region that is irradiated. This heat causes a proportion of the matrix material to be vaporised and explosively ejected from the surface as a plume of gaseous material (desorption). Analyte ions embedded within the matrix that is desorbed are transferred to the gaseous phase along with the matrix.

Reactions between the matrix ions and the analyte molecules can result in the analyte molecules being ionised either through protonation/deprotonation or through the removal or addition of an ion. Upon dispersal of the initial MALDI plume, the remaining analyte ions are predominantly singly charged.

Although the absorption of the laser radiation occurs at all levels of laser fluence, there is a threshold energy density required in order to obtain desorption of material under illumination.

MALDI imaging is a growing technique where the sample to be analysed may be a thin (typically 15 μm) section of tissue, with a layer of matrix deposited upon the surface of the sample. The sample is scanned in a raster manner, with the laser firing at specific locations or ranges of locations spaced along the raster pattern. Mass spectra are acquired at each location or range of locations and the relative abundance of ion masses are then displayed as an ion image of the tissue section.

Large matrix arrays can be generated to cover entire tissue sections (i.e. ion imaging) or smaller arrays can be used to study different areas within the tissue (e.g. depth profiling).

The aim of depth profiling is to obtain information on the variation of composition with depth below the initial surface of the sample. The information which is obtained is particularly useful for the analysis of layered structures such as those produced in the semiconductor industry.

Laser Desorption Ionisation relies upon the removal of ions from the surface of a sample and hence is, by its nature, a destructive technique. Laser Desorption Ionisation may be used for depth profiling applications. A depth profile of a sample may be obtained by recording sequentially spectra as the surface is gradually eroded away by the incident laser beam probe. A plot of the intensity of a given mass or mass to charge ratio signal as a function of time may be produced which is a direct reflection of the variation of its abundance or concentration with depth below the surface.

MALDI tissue profiling and ion imaging techniques have become valuable tools for rapid, direct analysis of tissues to investigate spatial distributions of proteins.

However, the production of mass spectra relating to each of the different areas within a tissue sample requires discrete analyses which is time consuming and reduces instrument yield.

US 2005/0116158 (University of Manitoba) discloses an ion transmission device or interface between a pulsed ion source and a mass spectrometer. The ion transmission device comprises a multipole rod set and includes a damping gas to damp spatial and energy spreads of ions generated by the pulsed ion source. The disclosed arrangement attempts to homogenise ions emitted by the pulsed ion source into a quasi-continuous beam. Broadening the pulse increases the probability of a pusher region of a Time of Flight mass analyser having ions present in the pusher region at the time when the electrodes forming the pusher region are energised. If the packets of ions were still of a size comparable to the time of ion formation (i.e. approx. 3 ns laser pulse duration) then the probability of ions being in the pusher region would be relatively low.

It is known to address this problem in a different manner by timing and synchronising the release of ion packets from a device with energisation of the pusher electrodes. As a result, ions can always be arranged to be present in the pusher region at the precise time when the pusher electrodes are energised. This results in a High Duty Cycle ("HDC") mode of operation.

Operating a mass spectrometer in a HDC mode in conjunction with a travelling wave ion mobility spectrometer enables ions within a desired mass range of interest to be present in the pusher region when the pusher electrodes are energised. As a result, there is no need to broaden the pulses of ions to ensure that the ions are sampled. The delay time between releasing ion packets and the timing of energising the pusher electrode may be calibrated for the expected mass range of ions emerging from e.g. the ion mobility spectrometer.

It is desired to provide an improved method of mass spectrometry and an improved mass spectrometer.

SUMMARY OF THE PRESENT INVENTION

According to an aspect of the present invention there is provided a method of mass spectrometry comprising:

providing a pulsed ion source;

energising the ion source one or more times to generate a first group of ions;

energising the ion source one or more times to generate a second different group of ions; and simultaneously transmitting both the first group of ions and the second group of ions through a portion or section of a mass spectrometer whilst keeping the first and second groups of ions isolated from each other.

The first group of ions may comprise one or more first sub-groups of ions and wherein either: (i) the one or more first sub-groups of ions are kept isolated from each other; or (ii) at least some of the one or more first sub-groups of ions are not kept isolated from each other and/or are allowed to merge with each other.

The second group of ions may comprise one or more second sub-groups of ions and wherein either: (i) the one or more second sub-groups of ions are kept isolated from each other;

or (ii) at least some of the one or more second sub-groups of ions are not kept isolated from each other and/or are allowed to merge with each other.

The method may further comprise energising the ion source one or more times to generate a third group of ions and simultaneously transmitting the first, second and third groups of ions through the portion or section of the mass spectrometer whilst keeping the first, second and third groups of ions isolated from each other.

The third group of ions may comprise one or more third sub-groups of ions and wherein either: (i) the one or more third sub-groups of ions are kept isolated from each other; or (ii) at least some of the one or more third sub-groups of ions are not kept isolated from each other and/or are allowed to merge with each other.

The method may further comprise energising the ion source one or more times to generate a fourth group of ions and simultaneously transmitting the first, second, third and fourth groups of ions through the portion or section of the mass spectrometer whilst keeping the first, second, third and fourth groups of ions isolated from each other.

The fourth group of ions preferably comprises one or more fourth sub-groups of ions and wherein either: (i) the one or more fourth sub-groups of ions are kept isolated from each other; or (ii) at least some of the one or more fourth sub-groups of ions are not kept isolated from each other and/or are allowed to merge with each other.

The method may further comprise energising the on source one or more times to generate a fifth (or further) group of ions and simultaneously transmitting the first, second, third, fourth and fifth (or further)groups of ions through the portion or section of the mass spectrometer whilst keeping the first, second, third, fourth and fifth (or further) groups of ions isolated from each other.

The fifth (or further) group of ions preferably comprises one or more fifth (or further) sub-groups of ions and wherein either: (i) the one or more fifth(or further) sub-groups of ions are kept isolated from each other; or (ii) at least some of the one or more fifth (or further) sub-groups of ions are not kept isolated from each other and/or are allowed to merge with each other.

The method preferably further comprises providing one or more ion guides each comprising a plurality of electrodes.

The one or more on guides are preferably selected from the group consisting of:

(a) an ion tunnel ion guide comprising a plurality of electrodes, each electrode comprising one or more apertures through which ions are transmitted in use;

(b) an ion funnel ion guide comprising a plurality of electrodes, each electrode comprising one or more apertures through which ions are transmitted in use and wherein a width or diameter of an ion guiding region formed within the ion funnel ion guide increases or decreases along the axial length of the ion guide;

(c) a conjoined ion guide comprising: (i) a first ion guide section comprising a plurality of electrodes each having an aperture through which ions are transmitted and wherein a first ion guiding path is formed within the first ion guide section; and (ii) a second ion guide section comprising a plurality of electrodes each having an aperture through which ions are transmitted and wherein a second ion guiding path is formed within the second ion guide section, wherein a radial pseudo-potential barrier is formed between the first ion guiding path and the second ion guiding path;

(d) a multipole or segmented multipole rod set; or (e) a planar ion guide comprising a plurality of planar electrodes arranged parallel to or orthogonal to a longitudinal axis of the ion guide.

The method preferably further comprises confining ions radially within the one or more ion guides.

The method preferably further comprises applying an AC or RF voltage to at least some of the plurality of electrodes in order to create a pseudo-potential which acts to confine ions radially and/or axially within the one or more ion guides.

The step of simultaneously transmitting both the first and second groups of ions and/or the third and/or fourth and/or fifth groups of ions preferably comprises transmitting the first and second groups of ions and/or the third and/or fourth and/or fifth groups of ions within the one or more ion guides.

The step of simultaneously transmitting both the first and second groups of ions and/or the third and/or fourth and/or fifth groups of ions preferably comprises translating a plurality of DC and/or pseudo-potential wells along the length of the one or more ion guides.

The method preferably further comprises applying one or more transient, intermittent or permanent DC voltages to the electrodes in order to keep the first and second groups of ions and/or the third and/or fourth and/or fifth groups of ions isolated from each other.

The method preferably further comprises axially confining the first group of ions in one or more first DC and/or pseudo-potential wells and/or axially confining the second group of ions in one or more different second DC and/or pseudo-potential wells and/or axially confining the third and/or fourth and/or fifth groups of ions in one or more different third and/or fourth and/or fifth DC and/or pseudo-potential wells.

The first group of ions in the first DC and/or pseudo-potential wells are preferably prevented from mixing with the second group of ions in the second DC and/or pseudo-potential wells and/or are prevented from mixing with the third and/or fourth and/or fifth groups of ions in the third and/or fourth and/or fifth DC and/or pseudo-potential wells.

The portion or section of the mass spectrometer may comprise one or more ion guides.

The portion or section of the mass spectrometer may comprise one or more ion mobility spectrometers or separators.

The portion or section of the mass spectrometer is preferably arranged upstream of a mass analyser.

According to an embodiment all the ions in the first group of ions are transmitted to an ion-optical component before any ions in the second group of ions are transmitted to the ion-optical component.

According to another embodiment all the ions in the second group of ions are transmitted to an ion-optical component before any ions in the first group of ions are transmitted to the ion-optical component.

The ion-optical component is preferably selected from the group consisting of: (i) an ion mobility spectrometer or separator; (ii) a mass analyser: (iii) an ion guide; (iv) an ion fragmentation or reaction device; (v) a photo-dissociation or photo-activation device; and (vi) an ion trap.

According to an embodiment the method may comprise a method of ion imaging.

The first group of ions preferably results from ionising a first region of a substrate or sample and the second group of ions preferably results from ionising a second different region of a substrate or sample. The third, fourth, fifth (or further) groups of ions preferably result from ionising further preferably different regions of a substrate or sample.

The method may further comprise moving a substrate or sample relative to the pulsed ion source.

According to an embodiment the method may comprise obtaining first mass spectral data relating to the first group of ions and/or obtaining second mass spectral data relating to the second group of ions and/or obtaining third mass spectral data relating to the third group of ions and/or obtaining fourth mass spectral data relating to the fourth groups of ions and/or obtaining fifth mass spectral data relating to the fifth group of ions.

According to an embodiment the method may comprise correlating the first mass spectral data with a first location (e.g. on a substrate or sample) and/or correlating the second mass spectral data with a second location (e.g. on a substrate or sample) and/or correlating the third mass spectral data with a third location(e.g. on a substrate or sample) and/or correlating the fourth mass spectral data with a fourth location(e.g. on a substrate or sample) and/or correlating the fifth mass spectral data with a fifth location(e.g. on a substrate or sample).

The method may comprise a method of depth profiling a sample.

The pulsed ion source is preferably selected from the group consisting of: (i) a laser; (ii) a device for firing one or more ball bearing at a sample plate; (iii) a device for heating a location on a sample plate; and (iv) a piezo-electric device for exciting a location on a sample plate.

According to an embodiment the method may comprise:

(i) fragmenting and/or reacting and/or photo-dissociating and/or photo-activating the first group of ions one or more times to generate first and/or second and/or third and/or subsequent generation fragment ions; and/or (ii) fragmenting and/or reacting and/or photo-dissociating and/or photo-activating the second group of ions one or more times to generate first and/or second and/or third and/or subsequent generation fragment ions; and/or (iii) fragmenting and/or reacting and/or photo-dissociating and/or photo-activating the third and/or fourth and/or fifth group of ions one or more times to generate first and/or second and/or third and/or subsequent generation fragment ions.

According to an embodiment the method may comprise:

(i) mass analysing the first and/or second and/or third and/or fourth and/or fifth group of ions; and/or (ii) mass analysing first and/or second and/or third and/or subsequent generation fragment ions.

According to an embodiment the method may comprise:

(i) heating the first group of ions one or more times to aid desolvation of the first groups of ions; and/or (ii) heating the second group of ions one or more times to aid desolvation of the second groups of ions; and/or (iii) heating the third and/or fourth and/or fifth group of ions one or more times to aid desolvation of the third and/or fourth and/or fifth groups of ions.

According to an embodiment the step of heating the ions may comprise supplying a heated gas to an ion guiding region through which the ions pass.

According to an embodiment the method may comprise directing a laser beam onto the first and/or second and/or third and/or fourth and/or fifth groups of ions in order to aid desolvation of the first and/or second and/or third and/or fourth and/or fifth groups of ions.

According to another aspect of the present invention there is provided a mass spectrometer comprising:

a pulsed ion source; and a control system arranged and adapted:

(i) to energise the ion source one or more times to generate a first group of ions;

(ii) to energise the ion source one or more times to generate a second different group of ions; and (iii) to cause both the first group of ions and the second group of ions to be simultaneously transmitted through a portion or section of a mass spectrometer whilst keeping the first and second groups of ions isolated from each other.

The first group of ions preferably comprises one or more first subgroups of ions and wherein either: (i) the one or more first sub-groups of ions are kept isolated from each other; or (ii) at least some of the one or more first sub-groups of ions are not kept isolated from each other and/or are allowed to merge with each other.

The second group of ions preferably comprises one or more second sub-groups of ions and wherein either: (i) the one or more second sub-groups of ions are kept isolated from each other; or (ii) at least some of the one or more second sub-groups of ions are not kept isolated from each other and/or are allowed to merge with each other.

According to an embodiment the control system is arranged and adapted to energise the ion source one or more times to generate a third group of ions and to transmit simultaneously the first, second and third groups of ions through the portion or section of the mass spectrometer whilst keeping the first, second and third groups of ions isolated from each other.

The third group of ions preferably comprises one or more third sub-groups of ions and wherein either: (i) the one or more third sub-groups of ions are kept isolated from each other, or (ii) at least some of the one or more third sub-groups of ions are not kept isolated from each other and/or are allowed to merge with each other.

According to an embodiment the control system is arranged and adapted to energise the ion source one or more times to generate a fourth group of ions and to transmit simultaneously the first, second, third and fourth groups of ions through the portion or section of the mass spectrometer whilst keeping the first, second, third and fourth groups of ions isolated from each other.

The fourth group of ions preferably comprises one or more fourth sub-groups of ions and wherein either: (i) the one or more fourth sub-groups of ions are kept isolated from each other; or (ii) at least some of the one or more fourth sub-groups of ions are not kept isolated from each other and/or are allowed to merge with each other.

According to an embodiment the control system is arranged and adapted to energise the ion source one or more times to generate a fifth group of ions and to transmit simultaneously the first, second, third, fourth and fifth groups of ions through the portion or section of the mass spectrometer whilst keeping the first, second, third, fourth and fifth groups of ions isolated from each other.

The fifth group of ions comprises one or more fifth sub-groups of ions and wherein either: (i) the one or more fifth sub-groups of ions are kept isolated from each other or (ii) at least some of the one or more fifth sub-groups of ions are not kept isolated from each other and/or are allowed to merge with each other.

The mass spectrometer preferably further comprises one or more ion guides each comprising a plurality of electrodes.

The one or more ion guides are preferably selected from the group consisting of:

(a) an ion tunnel on guide comprising a plurality of electrodes, each electrode comprising one or more apertures through which ions are transmitted in use;

(b) an ion funnel ion guide comprising a plurality of electrodes, each electrode comprising one or more apertures through which ions are transmitted in use and wherein a width or diameter of an ion guiding region formed within the ion funnel ion guide increases or decreases along the axial length of the ion guide;

(c) a conjoined ion guide comprising: (i) a first ion guide section comprising a plurality of electrodes each having an aperture through which ions are transmitted and wherein a first ion guiding path is formed within the first ion guide section; and (ii) a second ion guide section comprising a plurality of electrodes each having an aperture through which ions are transmitted and wherein a second ion guiding path is formed within the second ion guide section, wherein a radial pseudo-potential barrier is formed between the first ion guiding path and the second ion guiding path;

(d) a multipole or segmented multipole rod set; or (e) a planar ion guide comprising a plurality of planar electrodes arranged parallel to or orthogonal to a longitudinal axis of the ion guide.

The one or more ion guides are preferably arranged and adapted to confine ions radially within the one or more ion guides.

The mass spectrometer preferably further comprises a device arranged and adapted to apply an AC or RF voltage to at least some of the plurality of electrodes in order to create a pseudo-potential which acts to confine ions radially and/or axially within the one or more ion guides.

The one or more ion guides are preferably arranged and adapted to transmit simultaneously transmit both the first and second groups of ions and optionally also the third and/or fourth and/or fifth (or further) groups of ions.

The mass spectrometer preferably further comprises a device arranged and adapted to translate a plurality of DC and/or pseudo-potential wells along the length of the one or more ion guides.

The mass spectrometer preferably further comprises a device arranged and adapted to apply one or more transient, intermittent or permanent DC voltages to the electrodes in order to keep the first and second groups of ions and/or the third and/or fourth and/or fifth groups of ions isolated from each other.

The mass spectrometer preferably further comprises a device arranged and adapted to axially confine the first group of ions in one or more first DC and/or pseudo-potential wells and/or axially confine the second group of ions in one or more different second DC and/or pseudo-potential wells and/or axially confine the third and/or fourth and/or fifth groups of ions in one or more different third and/or fourth and/or fifth DC and/or pseudo-potential wells.

The first group of ions in the first DC and/or pseudo-potential wells are preferably prevented from mixing with the second group of ions in the second DC and/or pseudo-potential wells and/or are prevented from mixing with the third and/or fourth and/or fifth groups of ions in the third and/or fourth and/or fifth DC and/or pseudo-potential wells.

The portion or section of the mass spectrometer preferably comprises one or more ion guides.

The portion or section of the mass spectrometer preferably comprises one or more ion mobility spectrometers or separators.

The portion or section of the mass spectrometer is preferably arranged upstream of a mass analyser.

According to an embodiment all the ions in the first group of ions are transmitted to an ion-optical component before any ions in the second group of ions are transmitted to the ion-optical component.

According to another embodiment all the ions in the second group of ions are transmitted to an ion-optical component before any ions in the first group of ions are transmitted to the ion-optical component.

The ion-optical component is preferably selected from the group consisting of: (i) an ion mobility spectrometer or separator; (ii) a mass analyser; (iii) an ion guide; (iv) an on fragmentation or reaction device; (v) a photo-dissociation or photo-activation device; and (vi) an ion trap.

The control system is preferably arranged and adapted to perform a method of ion imaging.

According to an embodiment the first group of ions results from ionising a first region of a substrate or sample and the second group of ions results from ionising a second different region of a substrate or sample. The third and/or fourth and/or fifth (or further) groups of ions preferably result from ionising other regions of the substrate or sample.

The mass spectrometer preferably further comprises a device arranged and adapted to move a substrate or sample relative to the pulsed ion source.

The control system is preferably further arranged and adapted to obtain first mass spectral data relating to the first group of ions and/or to obtain second mass spectral data relating to the second group of ions and/or to obtain third mass spectral data relating to the third group of ions and/or to obtain fourth mass spectral data relating to the fourth groups of ions and/or to obtain fifth mass spectral data relating to the fifth group of ions.

The control system is preferably further arranged and adapted to correlate the first mass spectral data with a first location (e.g. on a sample or substrate) and/or to correlate the second mass spectral data with a second location (e.g. on a sample or substrate) and/or to correlate the third mass spectral data with a third location (e.g. on a sample or substrate) and/or to correlate the fourth mass spectral data with a fourth location (e.g. on a sample or substrate) and/or to correlate the fifth mass spectral data with a fifth location (e.g. on a sample or substrate).

The control system is preferably arranged and adapted to perform a method of depth profiling a sample.

The pulsed ion source is preferably selected from the group consisting of: (i) a laser (ii) a device for firing one or more ball bearing at a sample plate; (iii) a device for heating a location on a sample plate; (iv) a piezo-electric device for exciting a location on a sample plate.

The control system is preferably further arranged and adapted:

(i) to fragment and/or react and/or photo-dissociate and/or photo-activate the first group of ions one or more times to generate first and/or second and/or third and/or subsequent generation fragment ions; and/or (ii) to fragment and/or react and/or photo-dissociate and/or photo-activate the second group of ions one or more times to generate first and/or second and/or third and/or subsequent generation fragment ions; and/or (iii) to fragment and/or react and/or photo-dissociate and/or photo-activate the third and/or fourth and/or fifth group of ions one or more times to generate first and/or second and/or third and/or subsequent generation fragment ions.

The mass spectrometer preferably further comprises a mass analyser arranged and adapted:

(i) to mass analyse the first and/or second and/or third and/or fourth and/or fifth group of ions; and/or (ii) to mass analyse first and/or second and/or third and/or subsequent generation fragment ions.

The mass spectrometer preferably further comprises:

(i) a heating device for heating the first group of ions one or more times to aid desolvation of the first groups of ions; and/or (ii) a heating device for heating the second group of ions one or more times to aid desolvation of the second groups of ions; and/or (iii) a heating device for heating the third and/or fourth and/or fifth group of ions one or more times to aid desolvation of the third and/or fourth and/or fifth groups of ions.

The mass spectrometer preferably further comprises a device for supplying a heated gas to the ions.

The mass spectrometer preferably further comprises a device arranged and adapted to direct a laser beam onto the first and/or second and/or third and/or fourth and/or fifth groups of ions in order to aid desolvation of the first and/or second and/or third and/or fourth and/or fifth groups of ions.

Advantageously, the preferred embodiment enables significant improvements in ion imaging and/or depth profiling applications since the preferred embodiment enables the integrity of each discrete ion packet to be maintained whilst allowing ions from multiple laser shots to be rapidly and simultaneously transmitted through the mass spectrometer whilst keeping the packets of ions segregated from each other thereby resulting in a significant increase in the rate of acquisition.

The preferred embodiment preferably enables more efficient matrix imaging and/or profiling to be performed.

The preferred embodiment comprises an improved and/or more flexible apparatus and method of mass spectrometry, particularly but not exclusively for MALDI techniques.

According to an aspect of the invention there is provided a method of mass spectrometry comprising the steps of providing a surface including an analyte; providing energy to a first co-ordinate on the surface to produce a first set of ions; and providing energy to a second co-ordinate on the surface to produce a second set of ions, wherein the first set of ions and the second set of ions are both present simultaneously in, but temporally segregated throughout or within, a mass spectrometer.

Preferably, the first set of ions and the second set of ions are segregated using segregation means or a segregator, which may comprise an ion confinement device, e.g. an RF ion confinement device, or an ion guiding means such as an ion guide or ion guiding device. The first set of ions and the second set of ions may be segregated by transient DC voltages and/or one or more permanent DC voltages and/or one or more intermittent DC voltages.

In some embodiments, the energy is provided using a pulsed energy source. The first set of ions may be produced from two or more pulses of energy on the first co-ordinate and/or ions produced from each pulse of energy on the first co-ordinate may be segregated from one another and/or ions produced from one or more pulses of energy on the first co-ordinate are segregated from ions produced from one or more further pulses of energy on the first co-ordinate to provide at least two first sets of ions.

The method may further comprise fragmenting ions within one of the at least two first sets of ions prior to analysis. The method may further comprise analysing a substantially fragmented set, e.g. a first set, of the at least two first sets of ions and/or analysing a substantially non-fragmented set, e.g. a second set, of the at least two first sets of ions.

The energy may be provided by a laser, for example from the group comprising: Nitrogen, Nd:YAG , $CO_2$, Er:YAG, UV and IR. The laser may comprise a pulse frequency, for example selected from the following ranges: 1-10 Hz, 10-100 Hz, 100-1000 Hz, 1000-10000 Hz, 10000-100000 Hz.

Alternatively, the energy may be provided by one or more of firing a laser at the back of the sample plate (as in laser spray), firing a ball bearing at the sample plate, heating a specific spot on the sample plate, a piezoelectric excitement of a spot on the sample plate.

The surface of the sample being analysed may further comprises a matrix, for example from the group comprising: 2,5-dihydroxy benzoic acid, 3,5-dimethoxy-4-hydroxycinnamic acid, 4-hydroxy-3-methoxycinnamic acid, α-cyano-4-hydroxycinnamic acid, Picolinic acid, 3-hydroxy picolinic acid.

The segregation means may contain a collision gas and/or ions segregated by the segregation means may be exposed to a source of heat, for example by providing a heated collision gas within the segregation means. Additionally or alternatively, the source of heat may comprises a radiant heat source.

The method may further comprise providing a laser to assist desolvation of ions within the segregation means. The energy may comprise a laser, e.g. fired or directed along a first path, for example wherein the segregation means surrounds at least a part of the first path.

The method may further comprise performing a Field Asymmetric Ion Mobility Spectrometry ("FAIMS") and/or Ion Mobility Spectrometry ("IMS") separation downstream of the ion confinement device and/or filtering downstream of the ion confinement device using a quadrupole. The method may further comprise fragmenting ions, e.g. using a collision cell downstream of the ion confinement device and/or moving the surface relative to the energy source, e.g. to enable the provision of energy to different co-ordinates. The method may further comprise correlating spectra with the first or second co-ordinate.

Another aspect of the invention provides an apparatus arranged and adapted to perform a method as described above.

A further aspect of the invention provides an apparatus for mass spectrometry, for example a mass spectrometer, comprising; a substrate for receiving a sample, an energy source for selectively providing energy to a first co-ordinate or a second co-ordinate on the substrate to produce ions and segregation means arranged to segregate, in use, throughout or within the apparatus or mass spectrometer a first set of ions produced at the first co-ordinate from a second set of ions produced at the second co-ordinate when the first and second sets of ions are present simultaneously in the apparatus or mass spectrometer.

The segregation means may comprise an ion confinement device or ion guide or guiding means or guiding device. The segregation means may be selected from the group comprising: an on tunnel with a transient, intermittent or permanent DC voltage applied to the electrodes, an ion funnel with a transient, intermittent or permanent DC voltage applied to the electrodes, a set of sandwich plates with a transient, intermittent or permanent DC voltage applied to the electrodes, a segmented multipole with a transient, intermittent or permanent DC voltage applied to the electrodes or a multipole with an intermittent or permanent DC voltage applied to the rods. The segregation means may comprise or be adapted to produce, induce or provide one or more transient DC voltages and/or one or more permanent DC voltages and/or one or more intermittent DC voltages.

The ion confinement device or ion guide or guiding means or guiding device may comprise an RF ion confinement device or ion guide or guiding means or guiding device. The apparatus may further comprise a quadrupole mass filter and/ or FAIMS device and/or IMS device and/or collision cell downstream of the ion confinement device or ion guide or guiding means or guiding device.

The substrate may be movable relative to the energy source, for example to enable the provision of energy to the first co-ordinate and/or the second co-ordinate.

The energy source may comprise a pulsed energy source, for example wherein the first set of ions may be produced from two or more pulses of the energy source on the first co-ordinate and/or the second set of ions may be produced from two or more pulses of the energy source on the second co-ordinate. The energy source may comprise a laser, e.g. from the group comprising: Nitrogen, Nd:YAG $CO_2$, Er:YAG, UV and IR. The laser may be arranged to pulse, e.g. at a frequency selected from the following ranges; 1-10 Hz, 10-100 Hz, 100-1000 Hz, 1000-10000 Hz, 10000-100000 Hz. The energy source may be provided by one or more of firing a laser at the back of the sample plate, firing a ball bearing at the sample plate, heating a specific spot on the sample plate or a piezoelectric excitement of a spot on the sample plate.

The segregation means may be arranged to segregate ions produced from each pulse of the energy source on the first co-ordinate from one another and/or to segregate ions produced from one or more pulses of energy on the first co-ordinate from each other, e.g. to provide at least two first sets of ions.

The apparatus may further comprise fragmenting means, e.g. for fragmenting at least some of one of the at least two first sets of ions prior to analysis and/or a mass analyser e.g. for analysing a first, substantially fragmented set of the at least two first sets of ions and/or for analysing a second, substantially non-fragmented set of the at least two first sets of ions.

The substrate may further comprises a matrix, for example from the group comprising: 2,5-dihydroxy benzoic acid, 3,5-dimethoxy-4-hydroxycinnamic acid, 4-hydroxy-3-methoxy-cinnamic acid, α-cyano-4-hydroxycinnamic acid, Picolinic acid, 3-hydroxy picolinic acid.

The segregation means may contain a collision gas and/or ions segregated by the segregation means may be exposed to a source of heat. For example, the source of heat may comprise a heated collision gas within the segregation means and/or the source of heat may comprise a radiant heat source.

The apparatus may further comprise a laser arranged to assist, desolvation of ions within the segregation means.

The energy source may comprise, in use, a laser beam directed along a first axis and the segregation means may surround at least a part of the first axis.

The apparatus may further comprise storage means capable of storing and correlating spectra with the first or second co-ordinate.

The on guiding device may comprise a travelling wave guide or guiding device and/or may be arranged or configured to generate, in use, a DC potential that travels along a portion thereof. Most if not all of the electrodes forming the ion guide may be connected to an AC or RF voltage supply. The resulting AC or RF electric field may be configured to radially confine ions within the ion guide by creating a pseudo-potential well. The AC or RF voltage supply may, but does not necessarily, output a sinusoidal waveform, and according to some embodiments a non-sinusoidal RF waveform such as a square wave may be provided. Preferably, at least some of the electrodes are connected to both a DC and an AC or RF voltage supply.

A repeating pattern of DC electrical potentials may be superimposed along the length of the ion guide such as to form a periodic waveform. The waveform may be caused to travel along the ion guide in the direction in which it is required to move the ions at constant velocity. In some embodiments a gas may be present by which the ion motion will be dampened by the viscous drag of the gas. The ions may therefore drift forwards with the same velocity as that of the travelling waveform and ions may exit from the ion guide with substantially the same velocity, irrespective of their mass.

The ion guide preferably comprises a plurality of segments. The ion guide is preferably segmented in the axial direction such that independent transient DC potentials can be applied, preferably independently, to each segment. The DC travelling wave potential is preferably superimposed on top of the AC or RF radially confining voltage and any constant or underlying DC offset voltage which may be applied to the segment. The DC potentials at which the various segments are maintained are preferably changed temporally so as to generate a travelling DC potential wave in the axial direction.

At any instant in time, a moving DC voltage gradient may be generated between segments so as to push or pull the ions in a certain direction. As the DC voltage gradient moves along the ion guide, so do the ions.

The DC voltage applied to each of the segments may be independently programmed to create a required waveform. The individual DC voltages on each of the segments are preferably programmed to change in synchronism such that the waveform is maintained but shifted in the direction in which it is required to move the ions.

The DC voltage applied to each segment may be programmed to change continuously or in a series of steps. The sequence of DC voltages applied to each segment may repeat at regular intervals, or, at intervals that may progressively increase or decrease.

Preferred configurations and/or features of the ion guide or, guiding device are disclosed in U.S. Pat. No. 6,812,453 the entire contents of which are incorporated herein by reference. Those skilled in the art will appreciate readily the synergistic combinations of ion guide features disclosed therein that would provide advantages in light of the present disclosure.

Preferably, the ion guiding device comprises a first ion guide including a first plurality of electrodes; and/or a second ion guide including a second plurality of electrodes; and/or a first device arranged and adapted to create one or more barriers, for example pseudo-potential barriers, at one or more points along the length of the ion guiding device, e.g. between a first ion guiding path of the first ion guide and a second ion guiding path of the second ion guide; and/or a second device arranged and adapted to transfer ions from the or a first ion guiding path of the first ion guide into the or a second ion guiding path of the second ion guide, for example by urging ions across one or more barriers or pseudo-potential barriers.

In some embodiments, each electrode of one or both of the first and second ion guides comprises at least one aperture through which ions are transmitted in use and/or wherein the or an ion guiding path is formed along or within the ion guide.

Ions may be transferred radially or with a non-zero radial component of velocity across one or more radial or longitudinal barriers e.g. pseudo-potential barriers, disposed between the first ion guide and the second ion guide. At least a portion of the first and second ion guide and/or at least a portion of the first and second ion guiding path is or are substantially parallel to one another. Ions may be transferred from the first on guide to the second ion guide and/or from the second ion guide to the first ion guide one or more times. Ions may, for example, be repeatedly switched back and forth between the two or more ion guides.

In some embodiments, the first plurality of electrodes comprises one or more first rod sets, for example wherein a first ion guiding path is formed along, or within the first ion guide. Additionally or alternatively, the second plurality of electrodes may comprise one or more second rod sets, for example wherein a second different on guiding path is formed along or within the second ion guide. In some embodiments, the first on guide and/or the second on guide comprise one or more axially segmented rod set on guides. The first ion guide and/or the second ion guide may comprise one or more segmented quadrupole, hexapole or octapole on guides or an ion guide comprising four or more segmented rod sets. The first on guide and/or the second on guide may comprise a plurality of electrodes having a cross-section selected from the group consisting of: (i) an approximately or substantially circular cross-section; (ii) an approximately or substantially hyperbolic surface; (iii) an arcuate or part-circular cross-section; (iv) an approximately or substantially rectangular cross-section; and (v) an approximately or substantially square cross-section.

The first ion guide and/or the second ion guide preferably comprise or further comprise a plurality of ring electrodes arranged around the one or more first rod sets and/or the one or more second rod sets. The first ion guide and/or the second ion guide may comprise, for example, between 4-30 or more rod electrodes. Adjacent or neighbouring rod electrodes may be maintained at opposite phase of an AC or RF voltage, According to some embodiments, the first plurality of electrodes are arranged in a plane in which ions travel in use, for example wherein a first ion guiding path is formed along or within the first ion guide. The second plurality of electrodes may be arranged in a plane in which ions travel in use for example wherein a second different ion guiding path is formed along or within the second ion guide.

In some embodiments, the first ion guide and/or the second ion guide comprises a stack or array of planar, plate, mesh or curved electrodes, wherein the stack or array of planar, plate, mesh or curved electrodes may comprise two or more, e.g. a plurality, of planar, plate, mesh or curved electrodes. The first ion guide and/or the second ion guide may be axially segmented, e.g. so as to comprise two or more, e.g. a plurality, of axial segments, for example wherein at least some of the first plurality of electrodes in an axial segment and/or at least some of the second plurality of electrodes in an axial segment are maintained in use at the same DC voltage.

The first device may be arranged and adapted to create one or more radial or longitudinal or non-axial pseudo-potential barriers at one or more points along the length of the ion guiding device between the first ion guiding path and the second ion guiding path. The second device may be arranged and adapted to transfer ions radially or with a non-zero radial component of velocity and an axial component of velocity from the first ion guiding path into the second ion guiding path, for example wherein the ratio of the radial component of velocity to the axial component of velocity is between 0.1 and 10.

In some embodiments, the first ion guide and the second ion guide are conjoined, merged, overlapped or open to one another for at least some of the length of the first ion guide and/or the second ion guide. Ions may be transferred radially between the first ion guide or the first ion guiding path and the second ion guide or the second ion guiding path over at least some of the length of the first ion guide and/or the second ion guide. One or more radial or longitudinal pseudo-potential barriers may be formed, in use, which separate the first on guide or the first on guiding path from the second on guide or the second ion guiding path along at least some of the length of the first ion guide and/or the second ion guide. A first pseudo-potential valley or field may be formed within the first on guide and a second pseudo-potential valley or field is formed within the second ion guide, for example wherein a pseudo-potential barrier separates the first pseudo-potential valley from the second pseudo-potential valley. Ions may be confined radially within the ion guiding device by either the first pseudo-potential valley or the second pseudo-potential valley. At least some ions may be urged or caused to transfer across the pseudo-potential barrier. The degree of overlap or openness between the first ion guide and the second ion guide may remain constant or vary, increase, decrease, increase in a stepped or linear manner or decrease in a stepped or linear manner along the length of the first and second ion guides.

In some embodiments, one or more of the first plurality of electrodes are maintained in a mode of operation at a first potential or voltage and/or one or more of the second plurality of electrodes are maintained in a mode of operation at a second potential or voltage, which second potential or voltage may be different from the first potential or voltage. A potential difference may be maintained in a mode of operation between one or more of the first plurality of electrodes and one or more of the second plurality of electrodes. The first plurality of electrodes or at least some of the first plurality of electrodes may be maintained in use at substantially the same first DC voltage and/or the second plurality of electrodes or at least some of the second plurality of electrodes may be maintained in use at substantially the same second DC voltage and/or at least some of the first plurality of electrodes and/or the second plurality of electrodes may be maintained at substantially the same DC or DC bias voltage or are maintained at substantially different DC or DC bias voltages.

The first ion guide may comprise a first central longitudinal axis and the second ion guide preferably comprises a second central longitudinal axis, for example wherein the first central longitudinal axis is substantially parallel with the second central longitudinal axis for at least some of the length of the first ion guide and/or the second ion guide and/or the first central longitudinal axis is not co-linear or co-axial with the second central longitudinal axis for at least some of the length of the first ion guide and/or the second ion guide and/or the first central longitudinal axis may be spaced at a constant distance or remains equidistant from the second central longitudinal axis for at least some of the length of the first ion guide and/or the second ion guide. The first central longitudinal axis may be a mirror image of the second central longitudinal axis for at least some of the length of the first ion guide and/or the second ion guide and/or the first central longitudinal axis may substantially track, follow, mirror or run parallel to and/or alongside the second central longitudinal axis for at least some of the length of the first ion guide and/or the second ion guide. The first central longitudinal axis may converge towards or diverge away from the second central longitudinal axis for at least some of the length of the first ion guide and/or the second ion guide and/or the first central longitudinal axis and the second central longitudinal may form a X-shaped or Y-shaped coupler or splitter ion guiding path. One or more crossover regions, sections or junctions may be arranged between the first ion guide and the second ion guide, for example wherein at least some ions may be transferred or are caused to be transferred from the first on guide into the second on guide and/or wherein at least some ions may be transferred from the second on guide into the first ion guide.

The ion guiding device may further comprise a first AC or RE voltage supply for applying a first AC or RE voltage to at least some of the first plurality of electrodes and/or the second plurality of electrodes. The first AC or RE voltage may have an amplitude of 50 V peak to peak, >1000 V peak to peak or any interval, e.g. any 50 V interval, therebetween. The first AC or RF voltage may have a frequency of <100 kHz. >10.0 MHz or any interval, e.g. any interval of 100 kHz, 500 kHz or more or less, therebetween.

The first AC or RF voltage supply may be arranged to supply adjacent or neighbouring electrodes of the first plurality of electrodes with opposite phases of the first AC or RF voltage and/or the first AC or RF voltage supply may be arranged to supply adjacent or neighbouring electrodes of the second plurality of electrodes with opposite phases of the first AC or RF voltage and/or the first AC or RF voltage may generates one or more radial pseudo-potential wells which act to confine ions radially within the first on guide and/or the second ion guide.

According to an embodiment, the ion guiding device further comprises a third device arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage.

The ion guiding device may further comprise a second AC or RF voltage supply, e.g. for applying a second AC or RF voltage to at least some of the first plurality of electrodes and/or the second plurality of electrodes. The second AC or RF voltage may have an amplitude of <50 V peak to peak, >1000 V peak to peak or any interval, e.g. any 50 V interval, therebetween. The second AC or RF voltage may have a frequency <100 kHz, >10.0 MHz or any interval, e.g. any interval of 100 kHz, 500 kHz or more or less, therebetween.

The second AC or RF voltage supply may be arranged to supply adjacent or neighbouring electrodes of the first plurality of electrodes with opposite phases of the second AC or RF voltage and/or the second AC or RF voltage supply may be arranged to supply adjacent or neighbouring electrodes of the second plurality of electrodes with opposite phases of the second AC or RF voltage and/or the second AC or RF voltage may generate one or more radial pseudo-potential wells which act to confine ions radially within the first ion guide and/or the second ion guide.

The ion guiding device may further comprise a fourth device arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage.

A non-zero axial and/or radial DC voltage gradient may be maintained in use across or along one or more sections or portions of the first ion guide and/or the second ion guide. According to an embodiment the on guiding device further comprises a device for driving or urging ions upstream and/or downstream along or around at least some of the length or on guiding path of the first ion guide and/or the second ion guide. The device may comprise a device for applying one more transient DC voltages or potentials or DC voltage or potential waveforms to at least some of the first plurality of electrodes and/or the second plurality of electrodes in order to urge at least some ions downstream and/or upstream along at least some of the axial length of the first ion guide and/or the second ion guide. The device may comprise a device arranged and adapted to apply two or more phase-shifted AC or RF voltages to electrodes forming the first ion guide and/or the second ion guide in order to urge at least some ions downstream and/or upstream along at least some of the axial length of the first ion guide and/or the second ion guide. The device may comprise a device arranged and adapted to apply one or more DC voltages to electrodes forming the first ion guide and/or the second ion guide in order create or form an axial and/or radial DC voltage gradient which has the effect of urging or driving at least some ions downstream and/or upstream along at least some of the axial length of the first ion guide and/or the second ion guide.

The ion guiding device may further comprise a fifth device arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or DC voltage or potential waveforms.

The ion guiding device preferably further comprises sixth device arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or DC voltage or potential waveforms are applied to the electrodes.

According to an embodiment the ion guiding device further comprises means arranged to maintain a constant non-zero DC voltage gradient along at least some of the length or ion guiding path of the first ion guide and/or the second ion guide.

The first ion guide and/or the second on guide may be arranged and adapted to receive a beam or group of ions and to convert or partition the beam or group of ions such that at least 1, 2, 3, 4, 5, 6, 7, 8, 9, 10, 11, 12, 13, 14, 15, 16, 17, 18, 19 or 20 separate packets of ions are confined and/or isolated within the first ion guide and/or the second ion guide at any particular time, and wherein each packet of ions is separately confined and/or isolated in a separate axial potential well formed in the first ion guide and/or the second ion guide.

According to an embodiment: (a) one or more portions of the first ion guide and/or the second ion guide may comprise an ion mobility spectrometer or separator portion, section or stage wherein ions are caused to separate temporally according to their ion mobility in the ion mobility spectrometer or separator portion, section or stage; and/or (b) one or more portions of the first or guide and/or the second ion guide may comprise a FAIMS portion, section or stage wherein ions are caused to separate temporally according to their rate of change of ion mobility with electric field strength in the FAIMS portion, section or stage; and/or (c) in use a buffer gas is provided within one or more sections of the first ion guide and/or the second ion guide: and/or (d) in a mode of operation ions are arranged to be collisionally cooled without fragmenting upon interaction with gas molecules within a portion or region of the first ion guide and/or the second ion guide; and/or (e) in a mode of operation ions are arranged to be heated upon interaction with gas molecules within a portion or region of the first ion guide and/or the second ion guide; and/or (f) in a mode of operation ions are arranged to be fragmented upon interaction with gas molecules within a portion or region of the first ion guide and/or the second ion guide; and/or (g) in a mode of operation ions are arranged to unfold or at least partially unfold upon interaction with gas molecules within the first ion guide and/or the second ion guide; and/or (h) ions are trapped axially within a portion or region of the first ion guide and/or the second ion guide.

The first ion guide and/or the second ion guide may further comprise a collision, fragmentation or reaction device, wherein in a mode of operation ions are arranged to be fragmented within the first on guide and/or the second ion guide by (i) Collisional Induced Dissociation ("CID"); (ii) Surface Induced Dissociation ("SID"); (iii) Electron Transfer Dissociation ("ETD"); (iv) Electron Capture Dissociation ("ECD"); (v) Electron Collision or Impact Dissociation; (vi) Photo Induced Dissociation ("PID"); (vii) Laser induced Dissociation; (viii) infrared radiation induced dissociation; (ix) ultraviolet radiation induced dissociation; (x) thermal or temperature dissociation: (xi) electric field induced dissociation, (xii) magnetic field induced dissociation; (xiii) enzyme digestion or enzyme degradation dissociation; (xiv) ion-ion reaction dissociation; (xv) ion-molecule reaction dissociation; (xvi) ion-atom reaction dissociation; (xvii) ion-metastable ion reaction dissociation; (xviii) ion metastable molecule reaction dissociation; (xix) ion-metastable atom reaction dissociation; and (xx) Electron Ionisation Dissociation ("EID").

According to another aspect of the present invention there is provided a computer readable medium comprising computer executable instructions stored on the computer readable medium, the instructions being arranged to be executable by a control system of a mass spectrometer comprising an ion guiding device comprising a first ion guide comprising a first plurality of electrodes and a second ion guide comprising a second plurality of electrodes, to cause the control system: (i) to create one or more pseudo-potential barriers at one or more points along the length of the ion guiding device between a first ion guiding path and a second ion guiding path; and (ii) to transfer ions from the first ion guiding path into the second ion guiding path by urging ions across the one or more pseudo-potential barriers. The computer readable medium is preferably selected from the group consisting of: (i) a ROM; (ii) an EAROM; (iii) an EPROM; (iv) an EEPROM; (v) a flash memory; and (vi) an optical disk.

In another optional feature of the invention, the ion guiding device may comprise two or more parallel conjoined ion guides. The two or more parallel conjoined ion guides may comprise a first ion guide and a second ion guide, wherein the first ion guide and/or the second ion guide are selected from the group consisting of: (i) an on tunnel on guide comprising a plurality of electrodes having at least one aperture through which ions are transmitted in use; and/or (ii) a rod set ion guide comprising a plurality of rod electrodes; and/or (iii) a stacked plate ion guide comprising a plurality of plate electrodes arranged generally in the plane in which ions travel in use.

Embodiments are contemplated wherein the ion guiding device may comprise a hybrid arrangement wherein one of the ion guides comprises, for example, an in tunnel and the other on guide comprises a rod set or stacked plate ion guide.

Preferable configurations and/or features of the on guiding device are described in WO2009/037483, the entire contents are incorporated herein by reference. Those skilled in the art will appreciate readily the synergistic combinations of ion guide features disclosed therein that would provide advantages in light of the present disclosure.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation)("DESI") ion source; (xvi) a Nickel-63 radioactive ion source; (xvii) an Atmospheric Pressure Matrix Assisted Laser Desorption ionisation ion source; (xviii) a Thermospray ion source; (xix) an Atmospheric Sampling Glow Discharge ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of (i) a Collisional induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser. Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xvi) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of; (i) a quadrupole mass analyser (ii) a 2D or linear quadrupole mass analyser (iii) a Paul or 3D quadrupole mass analyser; (iv) a Penning trap mass analyser (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of (i) a quadrupole mass filter (ii) a 2D or linear quadrupole ion trap; (iii) a Paul or 3D quadrupole ion trap; (iv) a Penning ion trap; (v) an ion trap; (vi) a magnetic sector mass filter (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an orbitrap® mass analyser comprising an outer barrel-like electrode and a coaxial inner spindle-like electrode, wherein in a first mode of operation ions are transmitted to the C-trap and are then injected into the orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1:
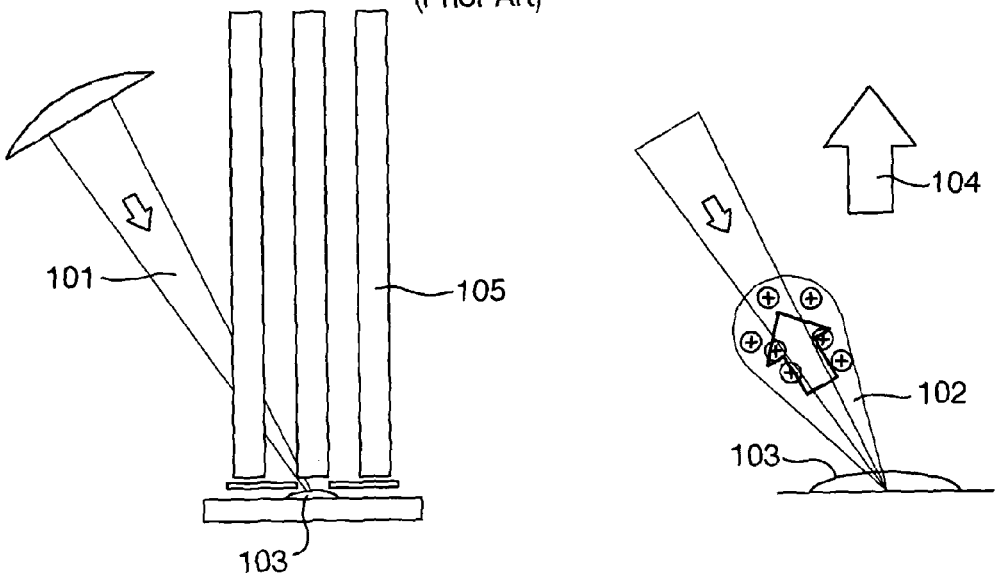
Fig. 1 (Prior Art)
FIG. 1 shows a known arrangement wherein a MALDI sample is illuminated by a laser beam.

A known arrangement will first be described. FIG. 1 shows a MALDI sample urinated by a laser beam 101. The angle of incidence of the laser beam 101 determines the dominant direction of emission of the resulting plume of material 102.

An RF ion guide 105 is shown adjacent the sample plate. The on guide 105 is arranged to have a direction of acceleration 104 and an axis of confinement 105 as shown. The RF on guide 105 is shown located adjacent a sample 103 as is the case for a typical MALDI mass spectrometer.

The plume 102 and the analyte ions therein which are formed subsequent to irradiation by the laser beam 101 tend to expand in a direction towards the incident laser beam 101. This is because of the inhomogeneous surface topography of the MALDI sample and crystalline matrix. Reference is made, for example, to P. Aksouh et al. Rapid Commun. Mass Spectrometry, 9 (1995) 515.

The ions formed in the MALDI plume 102 must be transferred into the analyser.

This requires locating electrodes in close proximity to the sample target. However, in high vacuum MALDI instruments, the requirement for electrostatic lenses also to be arranged along the ion optic axis to enable ion acceleration orthogonal to the sample plate 104 precludes the ability to locate laser optics along the same path. Consequently, conventional MALDI mass spectrometers are have the laser incident at a non-zero angle of incidence relative to the perpendicular to the sample plate.

With intermediate pressure MALDI, wherein a hexapole 105 ion guide may be used to transfer ions, the RF devices prevent the possibility of locating laser optics designed specifically to provide orthogonal illumination. Furthermore, the RF lenses limit the possibility of providing a final focus lens close to the MALDI sample plate. Similar constraints also apply to atmospheric pressure MALDI instrumentation.

Figure 2:
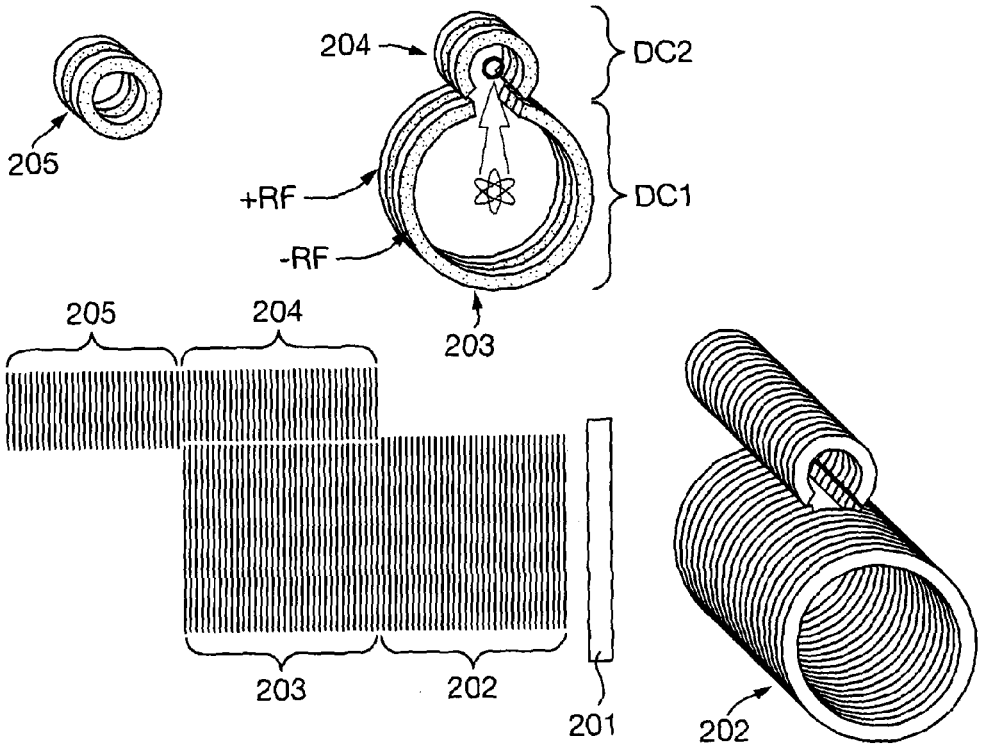
FIG. 2 illustrates the configuration of a three stage ion guide.

FIG. 2 shows an embodiment of the present invention comprising a three stage ion guide, showing the target plate 201, an initial large aperture ring stack 202, a large aperture ring stack 203 conjoined with a small aperture ring stack 204 and a small aperture ion guide 205, RF and DC voltages are applied to the conjoined elements. The direction of drift of the ion cloud within the conjoined elements from the large aperture to the small aperture is also indicated.

Figure 3:
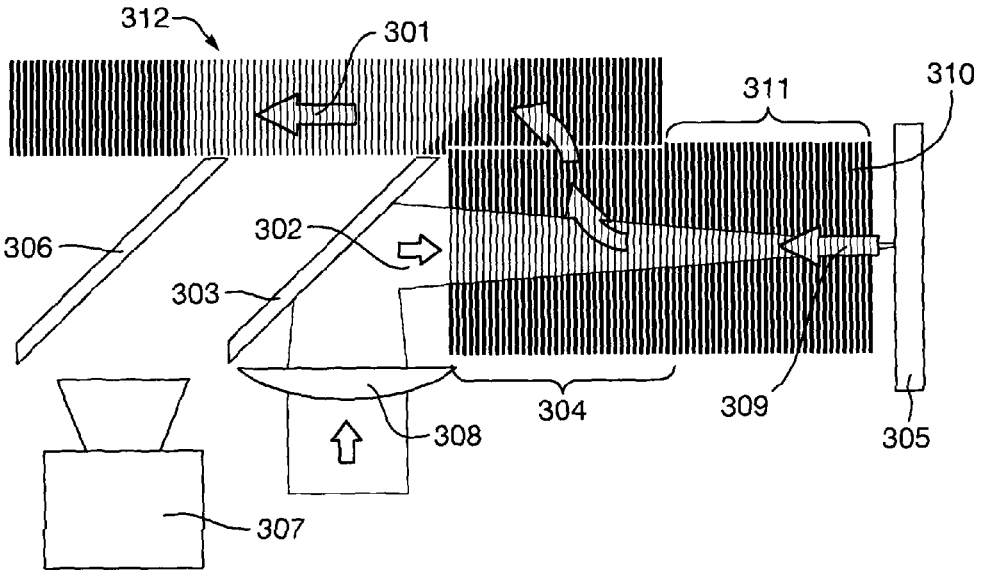
FIG. 3 shows an embodiment wherein a laser pulse is directed through a lens and onto the target sample plate.

FIG. 3 shows a preferred embodiment wherein a laser pulse 302 is directed through a lens 308 and onto the target sample plate 305 using a dichroic mirror 303 to produce an ion beam 309 which is subsequently directed away from the laser optic axis. The sample plate 305 is viewed by a camera 307 through the laser mirror.

A mass spectrometer is preferably provided for use in MALDI MS using a combination of mirrors 303 to direct the laser pulse 302 from the laser head (not shown) to the sample target plate 305. An optical lens 308 focuses the laser radiation onto the laser target plate 305. An RF guide 310 is arranged to collect and guide the ions generated in the MALDI plume and is preferably configured in such a way as to direct the ions along a path 301 away from the optic axis of the incident laser pulse 302. The laser beam is preferably directed orthogonal to the surface of the target sample plate 305.

The RF guide preferably comprises three separate regions: a first large aperture stack of ring electrodes 311 arranged such that the RF voltage applied to each sequential ring is in anti-phase with its immediate neighbours; a second region 304 comprising a large and small aperture conjoined RF guides wherein both ion guides are arranged such that the RF voltage applied each sequential ring is in anti-phase with its immediate neighbours and wherein a DC potential is applied between the two ion guides so as to drive ions across the radial pseudo-potential barrier which separates the two ion guiding regions; and a third region 312 preferably constructed using a small aperture RF guide arranged such that the RF voltage applied each sequential ring is in anti-phase with its immediate neighbours.

A DC offset voltage is preferably maintained between the two conjoined ion guides. The ion guide preferably provides a method of directing the ion beam away from the optic axis of the incident laser beam.

A DC potential difference or a DC pulsed square wave is preferably applied sequentially along the length of the ion guide and provides a mechanism to propagate ions along the ion guide.

According to a particularly preferred embodiment a pulsed DC square wave or other DC voltage may be arranged to collect and confine ions created from one or more pulses of the laser on an individual co-ordinate and transfer the ions into the mass spectrometer in one single packet keeping the ions segregated from the next packet.

The DC square wave preferably pushes sets of ions from the selected one or more pulses of the laser through the device and into the mass analysis section of the instrument. In the preferred embodiment, this results in ions from each packet within the mass spectrometer being able to be identified as being from one individual spot upon the target plate or sample.

According to an embodiment two packets of ions may be produced from the same spot, each packet may contain ions produced from one or more pulses on the same co-ordinate upon the target. The two packets may both be transferred through the ion confinement means, and the first set of ions passed straight through a collision cell following the ion confinement device. The ions may be propelled through the collision cell with sufficiently low energy that there will be few, or no fragmentation of the ions within the packet. The second set of ions may also be passed through the ion confinement device and into the collision cell. However, in this instance, the ions may be passed through the collision cell with higher energy such that all, most, or a substantial number of the ions will be fragmented giving daughter ions. Both these packets of ions may then pass through to the analyser for analysis to produce a mass spectrum. This may allow the parent and daughter ion mass spectra to be performed on ions from the same co-ordinate on the sample plate.

Once the two packets have been created in the ion confinement device, the sample plate may be moved on to the next co-ordinate where the laser may again be pulsed to create a set of ions from the next co-ordinate. These ions may be similarly separated from the previous sets of ions, and similarly, two packets may be formed in the same way as for the previous co-ordinate.

In the preferred embodiment the ion confinement means comprises an RF ion confinement device.

In the preferred embodiment ions created from the first co-ordinate and ions created from the second co-ordinate are segregated by transient DC voltages In a less preferred embodiment the ions created from the first co-ordinate and the ions created from the second co-ordinate are segregated by one or more permanent DC voltages.

In a less preferred embodiment the ions created from the first co-ordinate and the ions created from the second co-ordinate are segregated by one or more intermittent DC voltages.

In a less preferred embodiment the ions may be created by a pulsed energy source. In one embodiment of the invention, is two or more pulses of energy on the first co-ordinate are segregated within one packet.

In another embodiment of the invention, the ions produced from each pulse of energy on the first co-ordinate are segregated from each other.

In the most preferred embodiment the pulsed energy source is a laser. The laser may be from the group comprising: Nitrogen, Nef:YAG CO2, Er:YAG, UV and IR.

The laser may have a pulse frequency selected from the following ranges: 1-10 Hz, 10-100 Hz, 100-1000 Hz, 1000-10000 Hz, 10000-100000 Hz.

In less preferred embodiments the energy may be provided by firing a laser at the back of the sample plate, firing a ball bearing at the sample plate, heating a specific spot on the sample plate or piezoelectric excitement of a spot on the sample plate.

Preferably, the surface may also comprise a matrix to assist desorption and ionisation of the sample. The matrix may be from the group comprising: 2,5-dihydroxy benzoic acid, 3,5-dimethoxy-4-hydroxycinnamic acid, 4-hydroxy-3-methoxy-cinnamic acid, α-cyano-4-hydroxycinnamic acid, Picolinic acid, 3-hydroxy picolinic acid.

According to an embodiment the on confinement device may contain a collision gas. The collision gas may be used to cool the ions produced by the laser pulse to enable the ions to be more easily handled throughout the mass spectrometer. In a less preferred embodiment any fragmentation may be performed within the ion confinement device.

According to an embodiment the packets of ions segregated in the ion confinement device may be exposed to a source of heat in order to assist the desolvation of the ions. In the preferred embodiment the source of heat may be a heated collision gas within the ion confinement device. In less preferred embodiments, the source of heat comprises a radiant heat source. In a further embodiment of the invention, a laser may be provided to assist desolvation of ions within the ion confinement device In the preferred embodiments, the energy source may be provided on or along a first path and the ion confinement device surrounds at least a part of that first path.

Although various embodiments of the invention as described above show an energy source perpendicular to the sample surface, other less preferred embodiments are contemplated wherein the energy source is inclined at an angle to the sample surface.

According to the preferred embodiment the energy source is preferably arranged so as to be perpendicular because this provides optimum ionisation from each laser pulse. Furthermore, the energy source being perpendicular also provides optimum precision of the co-ordinate being exposed to energy from the energy source. Nonetheless, less preferred embodiments of the present invention are contemplated wherein the energy source is inclined at any angle to the sample surface provided that the energy source can provide energy to the sample. In less preferred embodiments the angle between the energy source path and the sample surface may be in the range of 70°-90°, 50°-70°, 30°-50° and 10°-30°.

In one embodiment, a FAIMS separation device may be provided downstream of the ion confinement device.

In one embodiment, a IMS separation device may be provided downstream of the ion confinement device, In one embodiment a mass filter may be provided downstream of the ion confinement device. In one preferred embodiment, this may be a quadrupole rod set.

In a preferred embodiment, the fragmentation of ions may be performed in a collision cell downstream of the ion confinement device.

In the preferred embodiment, once ions have been collected from one co-ordinate, the surface may be moved relative to the energy source to enable the provision of energy to different co-ordinates.

Preferably, the spectra produced from packets of ions from each co-ordinate may be correlated with the co-ordinates upon the sample surface from which the ions are produced.

Figure 4:
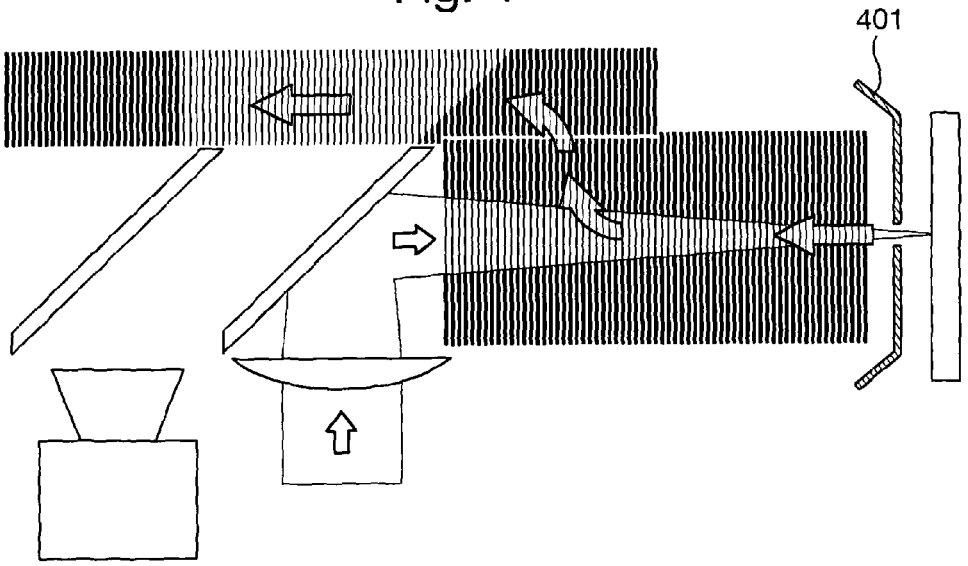
FIG. 4 illustrates the inclusion of an aperture between the sample plate and the RF ion guide.

FIG. 4 shows an embodiment wherein an aperture 401 is provided between the sample plate and the RF ion guide of FIG. 3 allowing differential pumping to create two different pressure regions.

Figure 5:
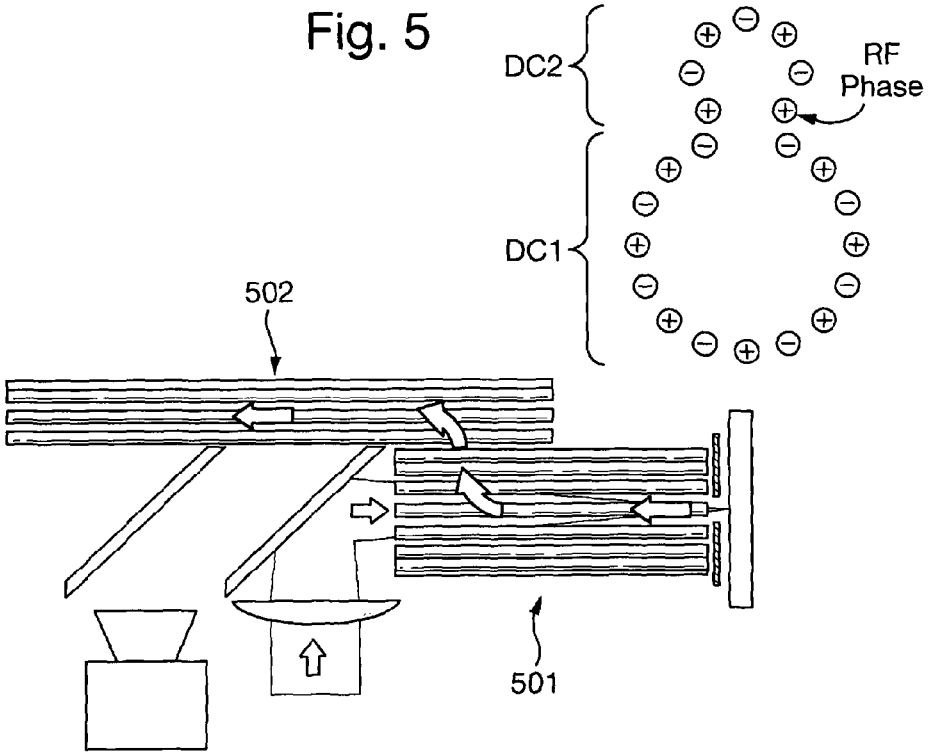
FIG. 5 shows a schematic showing an alternative embodiment.

FIG. 5 shows a schematic of a less preferred embodiment wherein RF rod sets 501,502 are used to generate a pseudo-potential well required to guide ions around the laser optic axis. The applied RF and DC voltages on the conjoined ion guide rod sets is also indicated. In this embodiment a continuous or an intermittent DC field may be applied along the ion guide to push ions through the device. After the ion guide 502 an ion separation device may be arranged to collect the ions from each pulse or group of pulses as required in packets to avoid merging of the consecutive packets.

Figure 6:
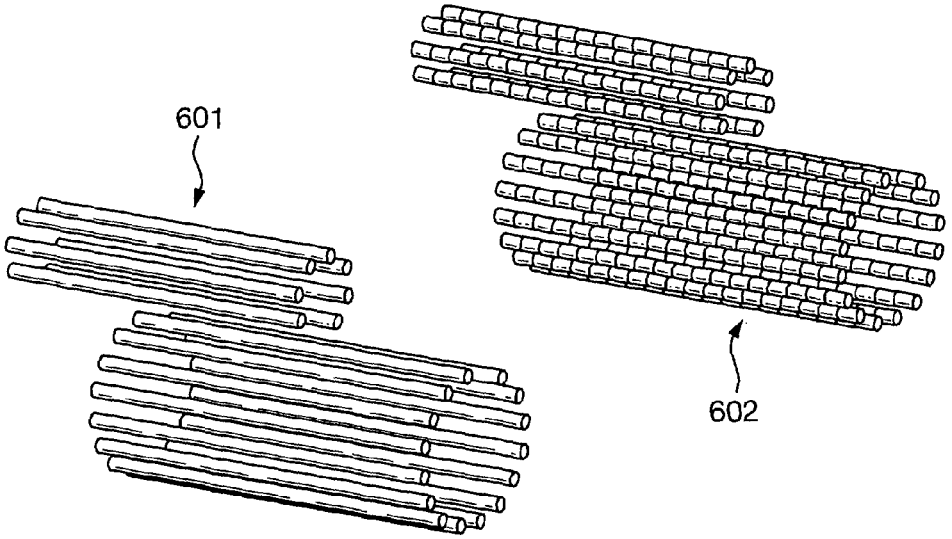
FIG. 6 shows a further embodiment.

FIG. 6 shows two rod set configurations. The first 601 uses continuous rods to create the conjoined ion guides, whilst the second 602 shows the rod sets segmented into smaller units so that DC voltages or a travelling pulse can be applied to each stage. The segmented rod set arrangement may be arranged to segregate the packets of ions in a similar way to the embodiment described above with reference to FIG. 3. If the rods are continuous, the approach as described above with reference to FIG. 5 may be used.

Figure 7:
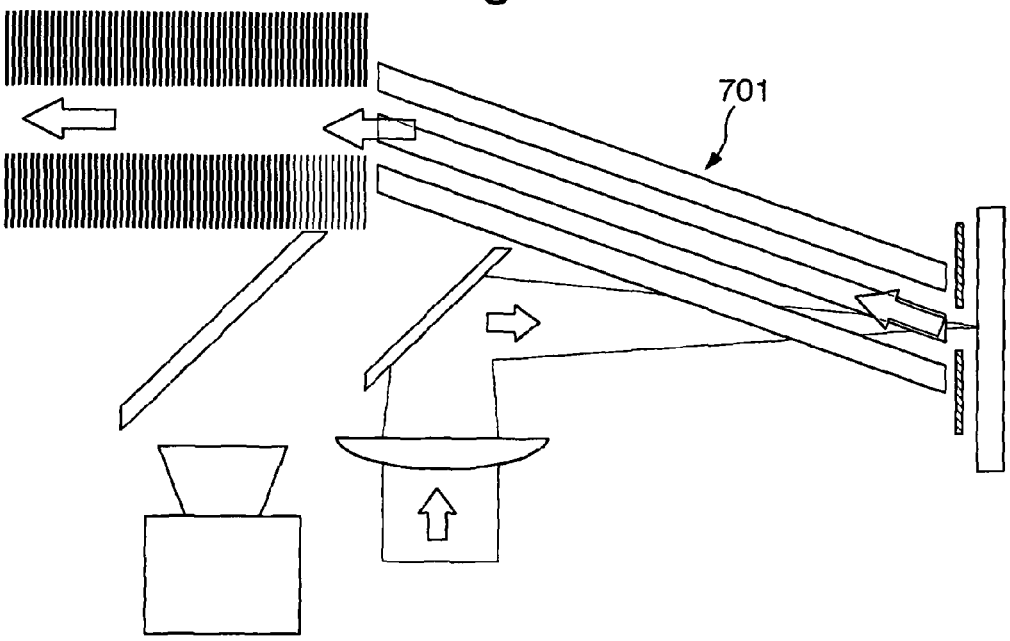
FIG. 7 illustrates an embodiment wherein a hexapole RF ion guide is mounted at an angle to draw ions away from the laser optic axis.

FIG. 7 illustrates a configuration using a hexapole RF guide 701 mounted at an angle to draw ions away from the laser optic axis. In one embodiment, the hexapole may have a continuous or intermittent DC voltage or voltage gradient maintained along into propel ions through the device. After the hexapole 701 an ion tunnel may be provided to collect the ions. In one, embodiment, in the ion tunnel, the ions can be received and kept in separate packets. Separate packets of ions are preferably segregated by transient or intermittent DC voltages which are preferably applied to the electrodes of the ion tunnel.

Figure 8:
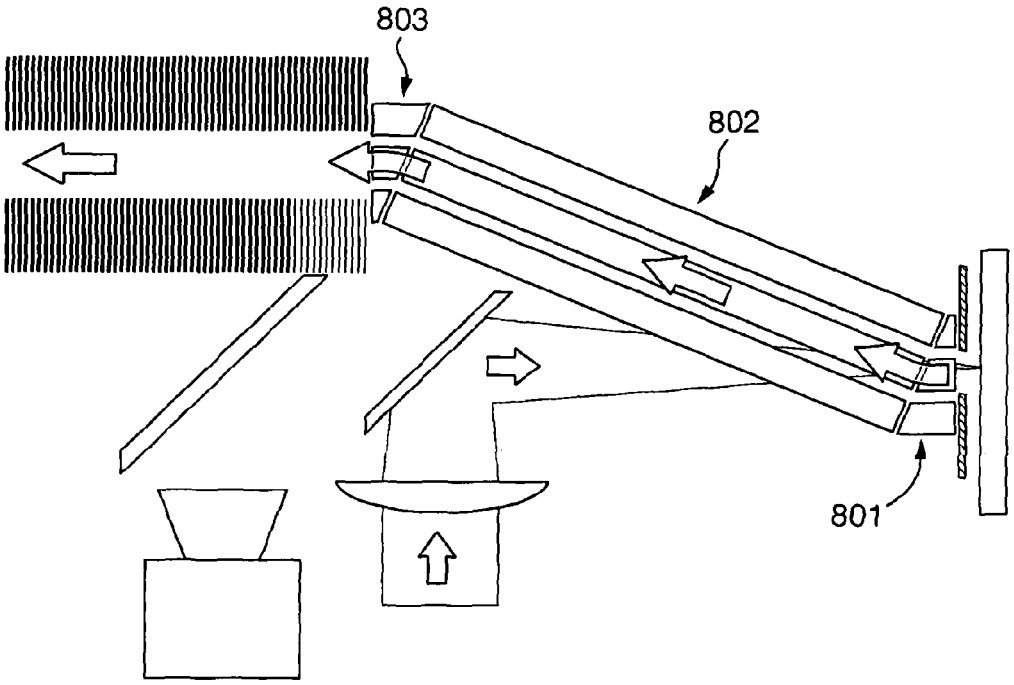
FIG. 8 shows an embodiment using hexapole ion guides in three parts.

FIG. 8 shows an embodiment comprising a hexapole ion guide in three parts. The initial rod set 801 is orthogonal to the sample target plate and is co-axial with the incident laser path. The main length of the hexapole 802 is preferably mounted at an angle. A third section 803 is preferably parallel to the first ion guide 801. In this embodiment, the ion guide may be arranged similar to the embodiment described above with reference to FIG. 7.

Figure 9:
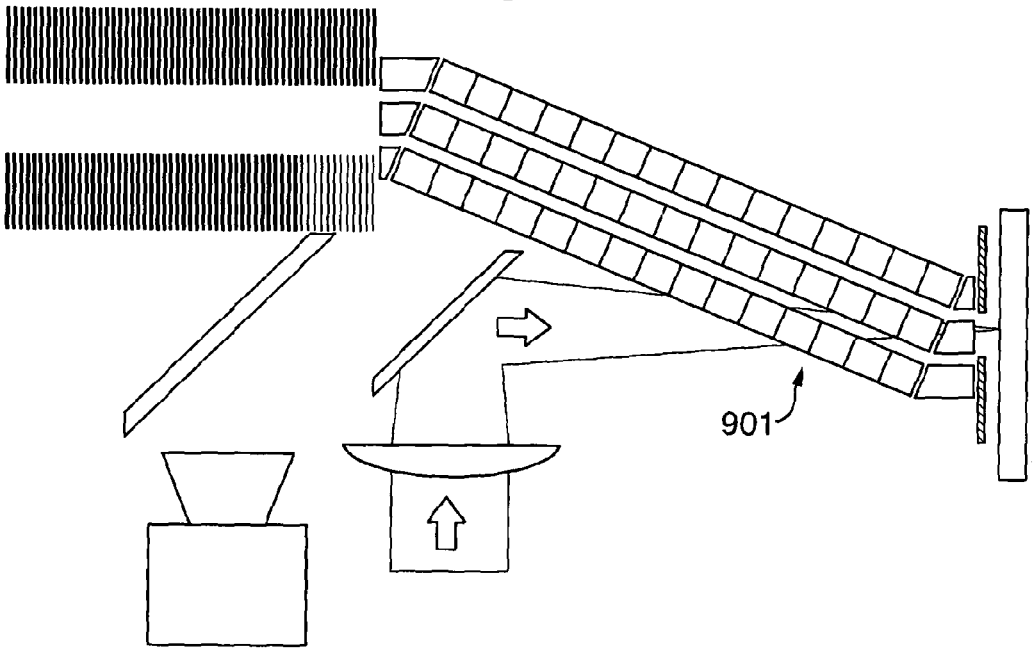
FIG. 9 shows an example of a segmented hexapole in accordance with an embodiment of the present invention.

FIG. 9 shows an example of how the main portion of the hexapole may be segmented 901 into smaller units so that DC voltages or a travelling pulse can be applied to each stage. This allows transient DC voltages to be applied to the elements within the device to enable segregation within the ion guide.

Figure 10:
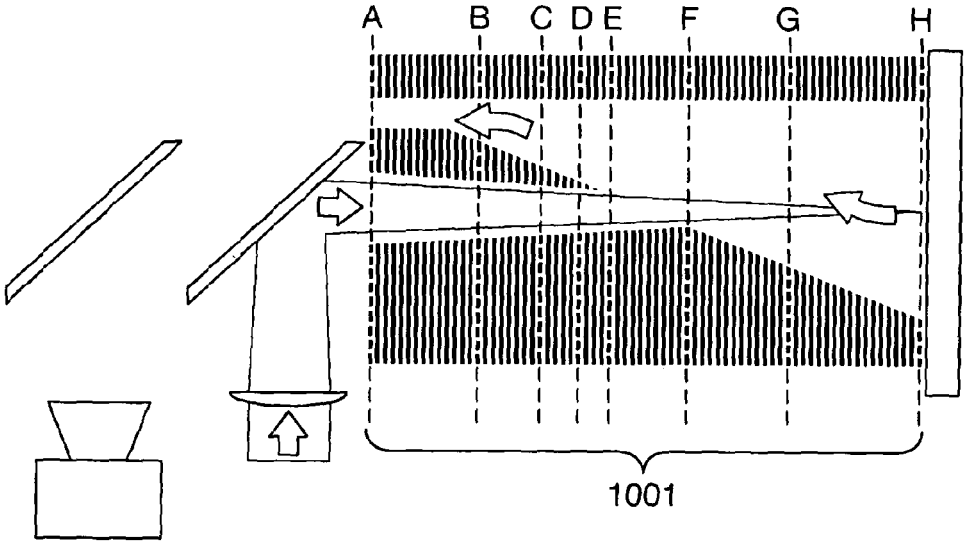
FIG. 10 shows a cross section of a sheared RF ion funnel in accordance with an embodiment of the present invention.

FIG. 10 shows a cross section of a sheared RF ion funnel 1001 with a central bore to enable the laser light to be directed orthogonally onto the sample target surface, whilst the ion current is drawn away from the optic axis. A transient, intermittent or continuous DC field may be applied along the ion funnel to propel the ions through the ion guide in a similar way to that described above with reference to FIG. 3.

Figure 11:
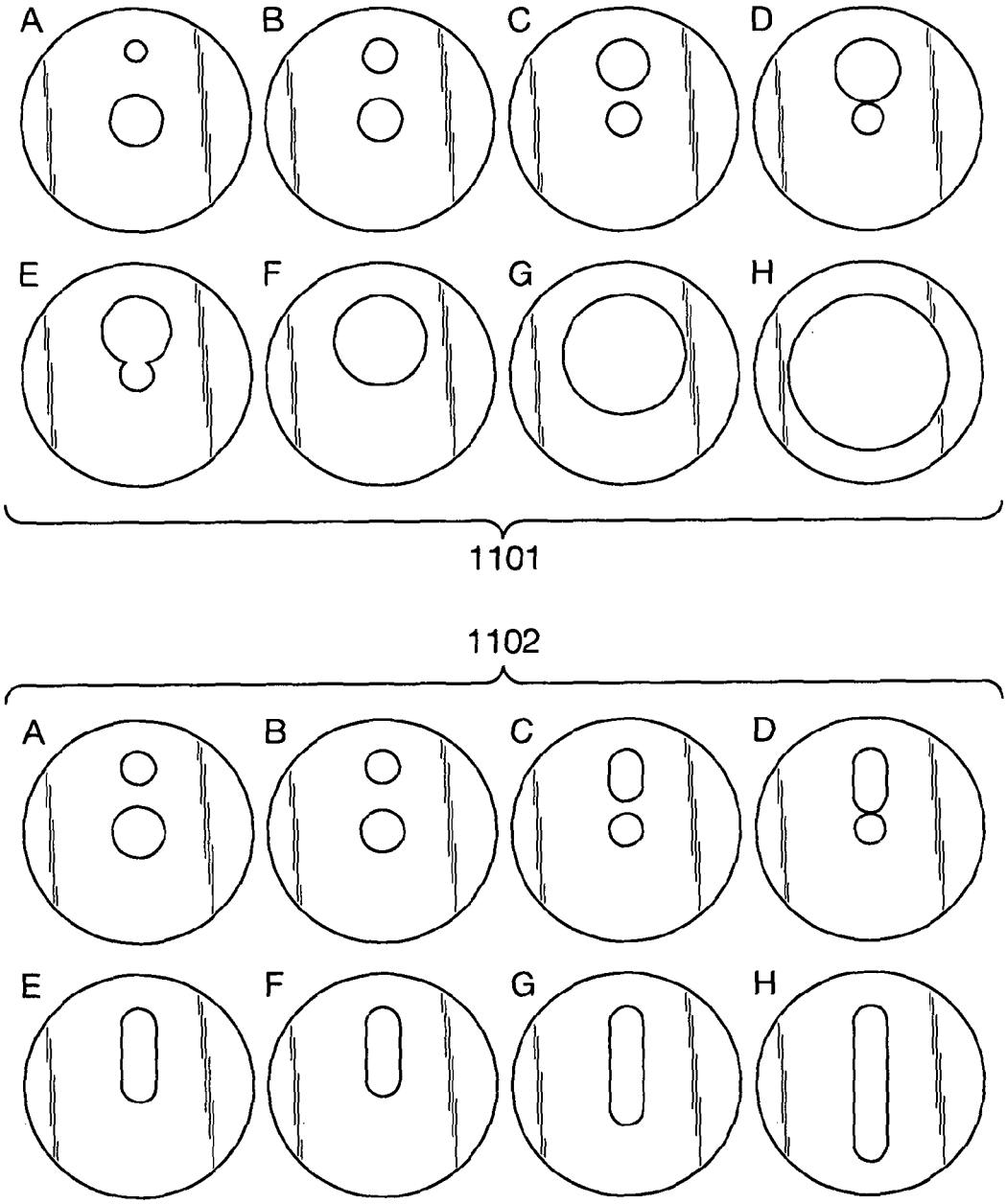
FIG. 11 shows a plan view of the electrodes in the sheared ion funnel as shown in FIG. 10.

FIG. 11 shows a plan view of the electrodes in a sheared ion funnel as shown, for example in FIG. 10, at different cross sections (marked A to H) using circular geometry apertures 1101 or slotted geometry apertures 1102.

Figure 12:
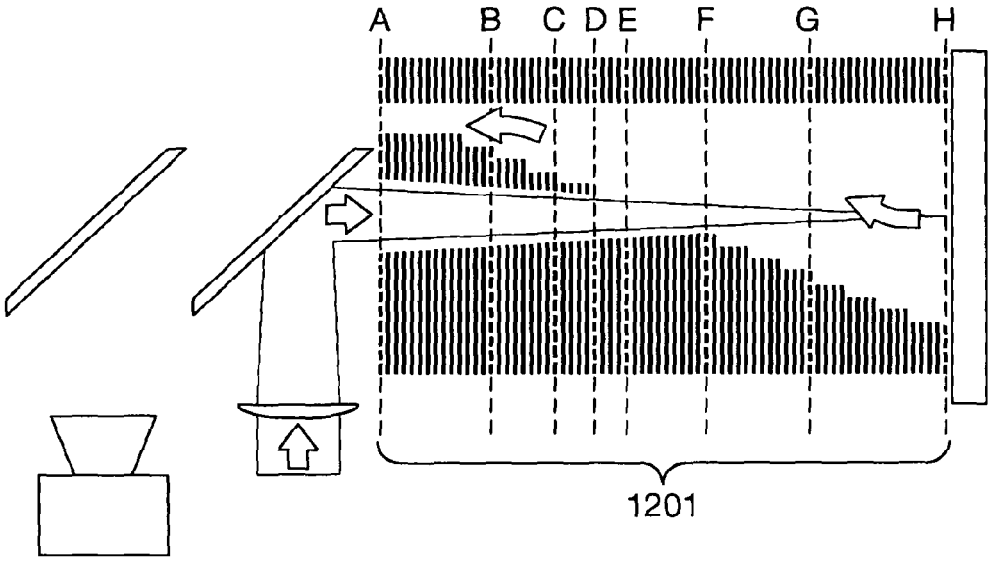
FIG. 12 shows a cross section of a sheared RF ion funnel constructed in stepped diameters.

FIG. 12 shows a cross section of a sheared RF ion funnel constructed in stepped diameters 1201 with a central bore to enable the laser light to be directed orthogonally onto the sample target surface, whilst the ion current is drawn away from the optic axis.

Figure 13:
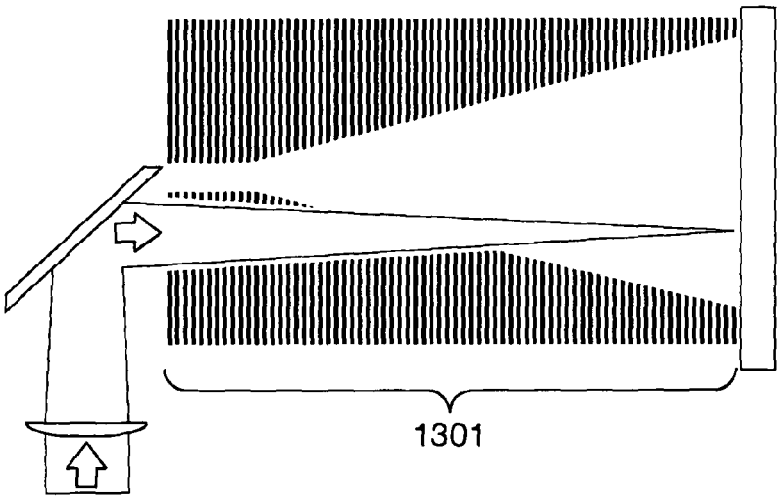
FIG. 13 shows a cross section of a symmetrical RF ion funnel.

FIG. 13 shows a cross section of a symmetrical RF ion funnel 1301 with an off-axis bore to enable the laser light to be directed orthogonally onto the sample target surface, whilst the ion current is drawn away from the optic axis.

Figure 14:
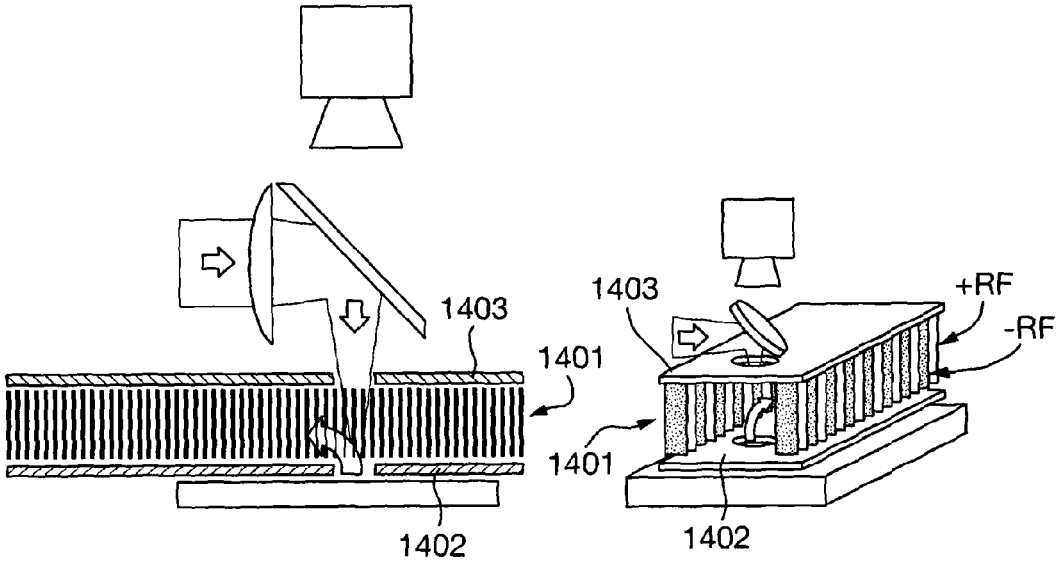
FIG. 14 shows a stacked plate geometry running parallel with the sample target plate.

FIG. 14 illustrates a stacked plate geometry running parallel with the sample target plate. RF voltages of opposite polarity are preferably applied to sequential plates 1401 with DC or travelling DC pulses superimposed upon the RF voltage.

DC voltages are preferably applied to the confining plates 1402 and 1403. A transient, intermittent or continuous DC field may be applied along the ion guide to propel the ions through the ion guide in a similar manner to the embodiment described above with reference to FIG. 3.

Figure 15:
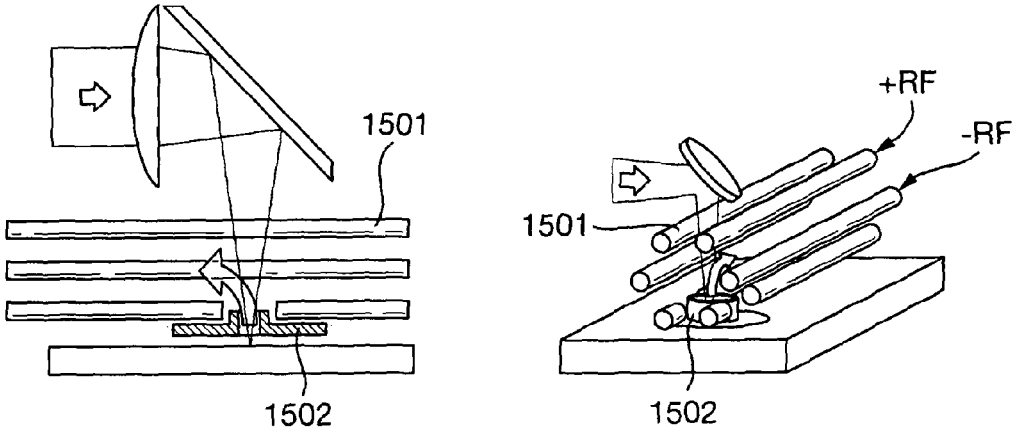
FIG. 15 shows a hexapole ion guide running parallel with the sample target plate.

FIG. 15 shows a hexapole ion guide 1501 running parallel with the sample target plate. A section in the lower two rods allows an extraction electrode 1502 with a DC voltage to draw ions from the sample and into the RF confinement. In this embodiment, a continuous or an intermittent DC field may be applied along the ion guide to push ions through the device. After the ion guide, an on separation device is preferably provided to collect the ions from each pulse or group of pulses as required in packets to avoid merging of the consecutive packets.

Figure 16:
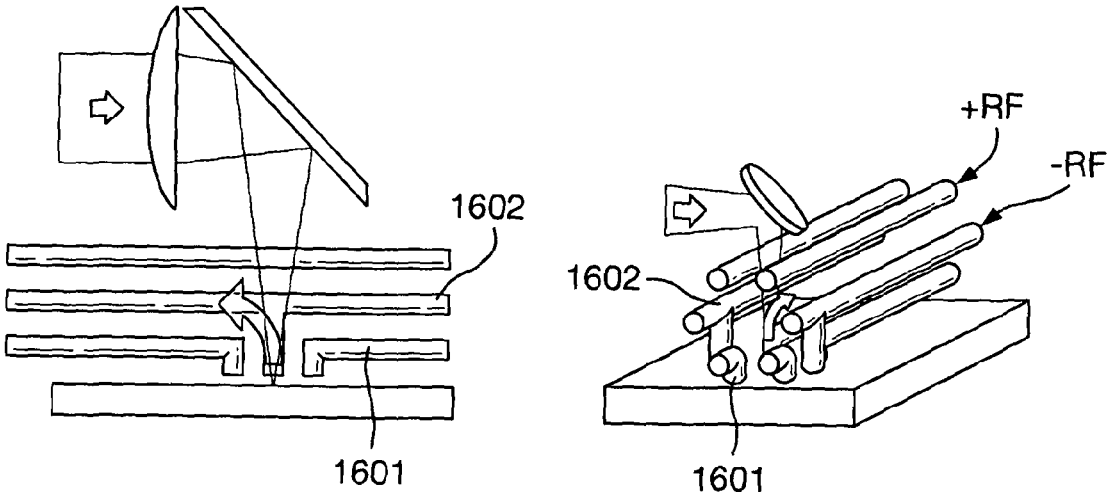
FIG. 16 shows a hexapole ion guide running parallel with the sample target plate

FIG. 16 shows a hexapole ion guide running parallel with the sample target plate. A section in the lower two rods guide allows four rods to be lowered towards the target sample surface producing four L-shaped rods 1601 and two extensions from the centre rods to descend between the L-shaped rods to form T-shaped rods 1602. In this embodiment a continuous or an intermittent DC field may be applied along the ion guide to push ions through the device. After the ion guide, an ion separation device would be arranged to collect the ions from each pulse or group of pulses as required in packets to avoid merging of the consecutive packets.

The laser source may comprise a solid state Nd:YAG producing pulsed laser radiation with a duration of between 500 ps and 10 ns at a wavelength of 355 nm. Alternative solid state laser sources such as Nd:YLF, or Nd:YVO4 or gas lasers such as nitrogen may also be used to produce UV wavelength in the range 266 to 360 nm or IR wavelength in the range 1 to 4 μm.

The laser pulse itself may be transmitted by reflection off a number of beam steering mirrors before the final focusing element or by coupling to on optical fibre with a core diameter between 50 to 300 μm, preferably with a core diameter of 150 μm. Beam transformation optical elements (diffractive or refractive optics, and/or micro-mechanical adjustable optics) may be included within the beam path to transform the spatial intensity profile of the propagating laser beam.

An inert gas within the volume of the confining RF preferably acts to reduce the radial kinetic energy of ions confined within the guide and reduces the internal energy of the ions by collisional cooling effects. The direction of flow on the gas may be opposing the ion drift trajectory to assist in screening the laser optics from the neutral species generated or along the ion drift trajectory to assist the transit of ions along the guide.

It will be apparent to those skilled in the art that various modifications may be made to the particular embodiments discussed above without departing from the scope of the invention. The deflection of the ion beam away from the laser optical axis may be precipitated by many variations in the geometries of the RF confining ion guides.

In the preferred embodiment, the presence of a DC voltage superimposed upon the RF voltage along one, two or three sections of a conjoined ion guide, or more preferably, a travelling wave pulse propagating along the guide, may be used to assist the transfer of ions along the ion guide.

In another preferred embodiment, the conjoined ring stack may be substituted for a set of RF guide rods (FIG. 5). These, in turn may be constructed from segments (FIG. 6) electrically isolated to enable a DC voltage or a travelling wave pulse propagating along the ion guide to be superimposed upon the RF voltage.

In a further embodiment, the RF guide may be sheared at an angle to confine the on beam in a direction deviating from the axis orthogonal to the target sample plate (FIG. 7). This may be included between two sections that are mounted parallel to the incident laser beam (FIG. 8) and may be orientated at an acute angle to the incident laser beam or at right-angles to the laser beam.

The angled ion guide may be constructed in segments (FIG. 9) electrically isolated to enable a DC voltage, or a travelling wave pulse propagating along the guide to be superimposed upon the RF voltage.

Another embodiment would be the employment of a sheared conical ion funnel with a central bore suitable for the transmission of the incident laser pulse onto the sample target plate in an orthogonal manner (FIG. 10). A DC voltage, or a travelling wave pulse propagating along the guide transmits the ions from the sample target plate to the exit of the ion guide. The ion guide may be fabricated using circular geometries, slots or other suitable shapes (FIG. 11).

The sheared conical funnel may be constructed also in steps of grouped electrodes (FIG. 12).

A cylindrically symmetric conical ion funnel including a bore located away from the central axis (FIG. 13) may be included to allow the laser pulse to be incident upon the sample target plate in an orthogonal manner to produce a plume of ions away from the central axis. The pseudo-potential well generated by the RF draws ions away from their initial point of formation towards the central axis of the ion funnel.

According to a further embodiment pairs of plate electrodes may be stacked in a line parallel with the sample target plate and sandwiched between two parallel plates (FIG. 14). A confining RF potential is preferably applied with inverted phase between each sequential pair of plates within the stack, producing a confining field in one axis, whilst a DC potential applied to the two plates sandwiching the stack confines the ions orthogonally to the RF confinement. An aperture within the sandwiching plates allows the laser to be delivered orthogonal to the sample target plate. Generated ions are drawn into the guide and propagated along the axis of the ion guide.

In a similar manner, an RF confining rod geometry such as a hexapole positioned parallel to the sample target plate may include break in the lower electrodes to accommodate an electrode with an aperture (FIG. 15) to which a DC potential may be applied to draw ions generated from the orthogonally incident laser pulse into the confining volume of the RF ion guide. Again, the ion guide may be constructed in segments electrically isolated to enable a DC voltage, or a travelling wave pulse propagating along the guide to be superimposed upon the RF voltage to drive ions along the ion guide.

In a variation to this, extension rods can be included at the ends of the broken rods, orthogonal to the RF guide axis, descending towards the target sample plate (FIG. 16) to form an L-shaped rod. Rods, connected to the rods forming the ion guide further from the sample target plate, form T-shaped rods. In this configuration, the confining RF is extended towards the sample target plate, and guides ions into the primary axis of the ion guide.

It will be appreciated by those skilled in the art that any number of combinations of the aforementioned features and/or those shown in the appended drawings provide clear advantages over the prior art and are therefore within the scope of the invention described herein.

The invention clamed is:

1. A method of mass spectrometry comprising:

providing a pulsed ion source;

energising said ion source one or more times to generate a first group of ions;

energising said ion source one or more times to generate a second different group of ions;

simultaneously transmitting both said first group of ions and said second group of ions through a portion or section of a mass spectrometer whilst keeping said first and second groups of ions isolated from each other;

providing a conjoined ion guide comprising: (i) a first ion guide section comprising a plurality of electrodes each having an aperture through which ions are transmitted and wherein a first ion guiding path is formed within the first ion guide section; and (ii) a second ion guide section comprising a plurality of electrodes each having an aperture through which ions are transmitted and wherein a second ion guiding path is formed within the second ion guide section, wherein a radial pseudo-potential barrier is formed between the first ion guiding path and the second ion guiding path;

directing a laser pulse through said first ion guiding path and onto a target to produce an ion beam; and directing the ion beam away from the optic axis of the incident laser pulse by transmitting said ion beam from said first ion guiding path into said second ion guiding path.

2. A method as claimed in claim 1, wherein said first or second group of ions comprises one or more first or second sub-groups of ions and wherein either: (i) said one or more first or second sub-groups of ions are kept isolated from each other; or (ii) at least some of said one or more first or second sub-groups of ions are not kept isolated from each other or are allowed to merge with each other.

3. A method as claimed in claim 1, further comprising energising said ion source one or more times to generate a third group of ions and simultaneously transmitting said first, second and third groups of ions through said portion or section of said mass spectrometer whilst keeping said first, second and third groups of ions isolated from each other.

4. A method as claimed in claim 3, wherein said third group of ions comprises one or more third sub-groups of ions and wherein either: (i) said one or more third sub-groups of ions are kept isolated from each other; or (ii) at least some of said one or more third sub-groups of ions are not kept isolated from each other or are allowed to merge with each other.

5. A method as claimed in claim 1, further comprising confining ions radially within said one or more ion guides.

6. A method as claimed in claim 1, further comprising applying an AC or RF voltage to at least some of said plurality of electrodes in order to create a pseudo-potential which acts to confine ions radially or axially within said one or more ion guides.

7. A method as claimed in claim 1, wherein the step of simultaneously transmitting both said first and second groups of ions or said third group of ions comprises transmitting said first and second groups of ions or said third group of ions within said one or more ion guides.

8. A method as claimed in claim 1, wherein the step of simultaneously transmitting both said first and second groups of ions or said third group of ions comprises translating a plurality of DC or pseudo-potential wells along the length of said one or more ion guides.

9. A method as claimed in claim 1, further comprising applying one or more transient, intermittent or permanent DC voltages to said electrodes in order to keep said first and second groups of ions or said third group of ions isolated from each other.

10. A method as claimed in claim 1, further comprising axially confining said first group of ions in one or more first DC or pseudo-potential wells or axially confining said second group of ions in one or more different second DC or pseudo-potential wells or axially confining said third group of ions in one or more different third or pseudo-potential wells.

11. A method as claimed in claim 10, wherein said first group of ions in said first DC or pseudo-potential wells are prevented from mixing with said second group of ions in said second DC or pseudo-potential wells or are prevented from mixing with said third group of ions in said third DC or pseudo-potential wells.

12. A method as claimed in claim 1, wherein all the ions in said first or second group of ions are transmitted to an ion-optical component before any ions in said second group of ions are transmitted to said ion-optical component.

13. A method as claimed in claim 1, wherein said method comprises a method of ion imaging.

14. A method as claimed in claim 13, wherein said first group of ions results from ionising a first region of a substrate or sample and said second group of ions results from ionising a second different region of a substrate or sample.

15. A mass spectrometer comprising:

a pulsed ion source;

a conjoined ion guide comprising: (i) a first ion guide section comprising a plurality of electrodes each having an aperture through which ions are transmitted and wherein a first ion guiding path is formed within the first ion guide section; and (ii) a second ion guide section comprising a plurality of electrodes each having an aperture through which ions are transmitted and wherein a second ion guiding path is formed within the second ion guide section, wherein a radial pseudo-potential barrier is formed between the first ion guiding path and the second ion guiding path; and a control system arranged and adapted:

(i) to energise said ion source one or more times to generate a first group of ions;

(ii) to energise said ion source one or more times to generate a second different group of ions; and (iii) to cause both said first group of ions and said second group of ions to be simultaneously transmitted through a portion or section of a mass spectrometer whilst keeping said first and second groups of ions isolated from each other (iv) to direct a laser pulse through said first ion guiding path and onto a target to produce an ion beam;

(v) to direct the ion beam away from the optic axis of the incident laser pulse by transmitting said ion beam from said first ion guiding path into said second ion guiding path.

16. A method conducted with a mass spectrometer including a pulsed ion source; and a conjoined ion guide comprising: (i) a first ion guide section comprising a plurality of electrodes each having an aperture through which ions are transmitted and wherein a first ion guiding path is formed within the first ion guide section; and (ii) a second ion guide section comprising a plurality of electrodes each having an aperture through which ions are transmitted and wherein a second ion guiding path is formed within the second ion guide section, wherein a radial pseudo-potential barrier is formed between the first ion guiding path and the second ion guiding path; said method comprising:

energising said ion source one or more times to generate a first group of ions;

energising said ion source one or more times to generate a second different group of ions;

simultaneously transmitting both said first group of ions and said second group of ions through a portion or section of a mass spectrometer whilst keeping said first and second groups of ions isolated from each other;

directing a laser pulse through said first ion guiding path and onto a target to produce an ion beam; and directing the ion beam away from the optic axis of the incident laser pulse by transmitting said ion beam from said first ion guiding path into said second ion guiding path.

17. A method as claimed in claim 16, further comprising energising said ion source one or more times to generate a third group of ions and simultaneously transmitting said first, second and third groups of ions through said portion or section of said mass spectrometer whilst keeping said first, second and third groups of ions isolated from each other.

18. A method as claimed in claim 16, further comprising applying an AC or RF voltage to at least some of said plurality of electrodes in order to create a pseudo-potential which acts to confine ions radially or axially within said one or more ion guides.

19. A method as claimed in claim 16, wherein the step of simultaneously transmitting both said first and second groups of ions or said third group of ions comprises transmitting said first and second groups of ions or said third group of ions within said one or more ion guides.

20. A method as claimed in claim 16, wherein all the ions in said first or second group of ions are transmitted to an ion-optical component before any ions in said second group of ions are transmitted to said ion-optical component.

* * * * *